US005827987A

United States Patent [19]

Kosugi

[11] Patent Number: 5,827,987

[45] Date of Patent: Oct. 27, 1998

[54] ELECTRONIC MUSICAL INSTRUMENT WITH A VARIABLE COEFFICIENTS DIGITAL FILTER RESPONSIVE TO KEY TOUCH

[75] Inventor: Taichi Kosugi, Hamamatsu, Japan

[73] Assignee: Kabushiki Kaisha Kawai Gakki Seisakusho, Shizuoka-ken, Japan

[21] Appl. No.: 882,336

[22] Filed: Jun. 25, 1997

[30] Foreign Application Priority Data

Jun. 25, 1996 [JP] Japan ..... 8-184132

[51] Int. Cl.[6] ..... G10H 1/08; G10H 1/12; G10H 7/02

[52] U.S. Cl. ..... 84/604; 84/622; 84/625; 84/DIG. 9

[58] Field of Search ..... 84/622–625, 658–661, 84/DIG. 9, 604–607

[56] References Cited

U.S. PATENT DOCUMENTS

| | | | |
|---|---|---|---|
| 4,700,603 | 10/1987 | Takauji et al. | 84/DIG. 9 |
| 4,909,121 | 3/1990 | Usa et al. | 84/DIG. 9 |
| 5,286,916 | 2/1994 | Yamauchi | 84/661 |
| 5,412,154 | 5/1995 | Takeda et al. | 84/622 |
| 5,450,350 | 9/1995 | Sakata | 84/DIG. 9 |
| 5,519,167 | 5/1996 | Kunimoto et al. | 84/661 |
| 5,554,813 | 9/1996 | Kakishita | 84/622 |
| 5,648,626 | 7/1997 | Okamoto | 84/658 X |
| 5,648,629 | 7/1997 | Kozuki | 84/660 |

*Primary Examiner*—Stanley J. Witkowski
*Attorney, Agent, or Firm*—Birch, Stewart, Kolasch & Birch, LLP

[57] ABSTRACT

Digital waveform data stored in a waveform memory is read out in response to the ON/OFF operations of key switches such as a keyboard of an electronic musical instrument. The waveform data is passed through a low-pass filter, then subjected to amplitude envelope processing such as attack, decay, release, and the like. The processed waveform data is D/A-converted to output it as a tone signal. A look-up table that stores resonant frequency data and resonance sharpness data (quality factor) of a filter in correspondence with the touch (operation strength or key-ON velocity) of the switch operation at, e.g., the keyboard is used. The resonant frequency and resonance sharpness data are read out from the table in correspondence with the touch data of the keyboard operation to control filter characteristics such as a cutoff frequency, roll-off or slope, and the like, by coefficient data to the filter.

22 Claims, 19 Drawing Sheets

FIG. 2

Ta

| Kn | Wn | Pn |
|---|---|---|
| 0 | 0 | 0 |
| 1 | 0 | 0 |
| 2 | 0 | 1 |
| 3 | 1 | 2 |
| 4 | 1 | 3 |
| ⋮ | ⋮ | ⋮ |
| N−1 | M−1 | L−1 |

FIG. 3

Tb

| Wn | Wa | | |
|---|---|---|---|
| 0 | ST | LT | LE |
| 1 | ST | LT | LE |
| ⋮ | ⋮ | ⋮ | ⋮ |
| M−1 | ⋮ | ⋮ | ⋮ |

ST : START ADDRESS

LT : LOOP−TOP ADDRESS

LE : LOOP−END ADDRESS

FIG. 4

Tc

| Pn | Pv | | | | | | | |
|---|---|---|---|---|---|---|---|---|
| 0 | AS | AL | D1S | D1E | D2S | RS | ωoB | QB |
| 1 | AS | AL | D1S | D1E | D2S | RS | ωoB | QB |
| ⋮ | ⋮ | ⋮ | ⋮ | ⋮ | ⋮ | ⋮ | ⋮ | ⋮ |
| L−1 | ⋮ | ⋮ | ⋮ | ⋮ | ⋮ | ⋮ | ⋮ | ⋮ |

AS : ATTACK SPEED
AL : ATTACK LEVEL
D1S : DECAY1 SPEED
D1E : DECAY1 END VALUE
D2S : DECAY2 SPEED
RS : RELEASE SPEED
ωoB : RESONANT FREQ. BIAS
QB : Q−BIAS

AMPLITUDE-FREQUENCY
CHARATERISTIC (Q: CONSTANT)

ELECTRONIC MUSICAL INSTRUMENT WITH A VARIABLE COEFFICIENTS DIGITAL FILTER RESPONSIVE TO KEY TOUCH

BACKGROUND OF THE INVENTION

1. [Field of the Invention]

The present invention relates to an electronic musical instrument such as an electronic piano and, more particularly, to an electronic musical instrument which can control the characteristics of tones generated in correspondence with the key-ON strength at a keyboard.

2. [Description of the Prior Art]

Conventionally, an electronic musical instrument that controls the characteristics of the tones to be generated by changing the cutoff frequency of a low-pass filter on the basis of so-called touch data that is the key-ON strength at a keyboard, as shown in, e.g., FIG. 21, is known.

However, in such conventional electronic musical instrument, when the cutoff frequency of the low-pass filter is to be changed, since the roll-off or slope characteristics are constant with respect to key touch data TC1, TC2, . . . , the tone characteristics change very unnaturally in some tone colors.

SUMMARY OF THE INVENTION

The present invention has been made to solve the above-mentioned problems and has as its object to provide an electronic musical instrument which can obtain natural, good changes in tone in correspondence with the key-ON operation strength at the keyboard.

An electronic musical instrument according to the present invention comprises tone generation instruction means for inputting tone generation start and stop instructions of a tone, detection means for detecting an operation strength upon inputting a tone generation instruction by the tone generation instruction means, control means for controlling generation of a tone on the basis of the tone generation instruction input by the tone generation instruction means and the detection result of the detection means, and tone generation means for generating a tone controlled by the control means, wherein the tone generation means includes a digital filter, filter characteristics of which are controlled based on a resonant frequency and a resonance sharpness value by the control means, and generates a tone using the filter characteristics controlled by the control means, and the control means includes first table means which stores a plurality of resonant frequency data in correspondence with operation strengths, and second table means which stores a plurality of resonance sharpness value data in correspondence with operation strengths, and controls the filter characteristics using resonant frequency data and the resonance sharpness value data selected from the first and second table means on the basis of the detection result of the detection means.

An electronic musical instrument according to the present invention comprises tone generation instruction means for inputting tone generation start and stop instructions of a tone, detection means for detecting an operation strength upon inputting a tone generation instruction by the tone generation instruction means, control means for controlling generation of a tone on the basis of the tone generation instruction input by the tone generation instruction means and the detection result of the detection means, and tone generation means for generating a tone controlled by the control means, wherein the tone generation means includes a digital filter, filter characteristics of which are controlled based on a resonant frequency and a resonance sharpness value by the control means, and generates a tone using the filter characteristics controlled by the control means, and the control means includes first table means which stores a plurality of resonant frequency data in correspondence with operation strengths, and second table means which stores a plurality of resonance sharpness value data in correspondence with the resonant frequency data, selects resonant frequency data from the first table means on the basis of the detection result of the detection means, and selects a resonance sharpness value from the second table means on the basis of the selected resonant frequency data.

According to the present invention, the resonant frequency and the value indicating resonance sharpness, which are used for controlling the filter characteristics of the tone generation means, are arbitrarily changed in correspondence with the operation strength upon inputting a tone generation instruction at the tone generation instruction means.

According to the present invention, the resonant frequency for controlling the filter characteristics of the tone generation means is arbitrarily changed in correspondence with the operation strength upon inputting a tone generation instruction at the tone generation instruction means, and the value indicating the resonance sharpness for controlling the filter characteristics of the tone generation means is arbitrarily changed in correspondence with the changed resonant frequency.

BRIEF DESCRIPTION OF THE DRAWINGS

FIG. 2 is a view for explaining a pointer table stored in a ROM;

FIG. 3 is a view for explaining a waveform address table stored in the ROM;

FIG. 4 is a view for explaining a parameter table stored in the ROM;

DETAILED DESCRIPTION OF THE PREFERRED EMBODIMENT

The preferred embodiment of the present invention will be described hereinafter with reference to the accompanying drawings.

Figure 1:
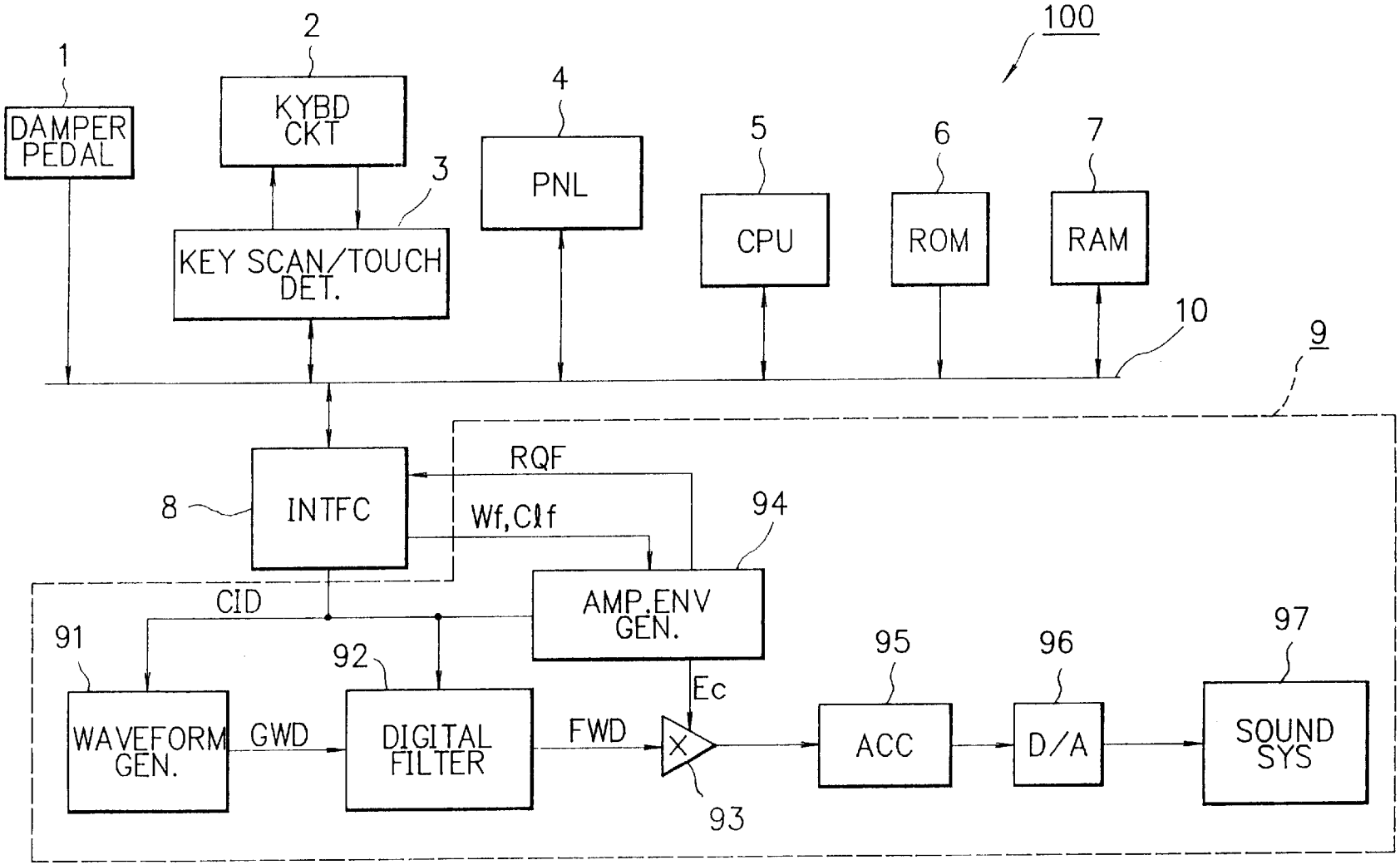
FIG. 1 is a block diagram showing the arrangement of an electronic musical instrument according to the present invention.

An electronic musical instrument according to the present invention is applied to, e.g., an electronic musical instrument 100 shown in FIG. 1.

As shown in FIG. 1, the electronic musical instrument 100 comprises a damper pedal 1, a keyboard circuit 2, a key scan/touch detection circuit 3 connected to the keyboard circuit 2, a panel circuit 4, a CPU 5, a ROM (read only memory) 6, a RAM (random access memory) 7, an interface circuit 8, and a tone generation circuit 9 connected to the interface circuit 8.

The damper pedal 1, the key scan/touch detection circuit 3, the panel circuit 4, the CPU 5, the ROM 6, the RAM 7, and the interface circuit 8 are connected to a bus line 10, and can communicate with each other.

The tone generation circuit 9 comprises a waveform generation circuit 91, a digital filter circuit 92, and an amplitude envelope generation circuit 94, which are connected to the interface circuit 8 via a data bus CID, a multiplier 93 which receives the outputs from the digital filter circuit 92 and the amplitude envelope generation circuit 94, an accumulation circuit 95 which receives the output from the multiplier 93, a digital/analog (D/A) converter 96 which receives the output from the accumulation circuit 95, and a sound system 97 which receives the output from the D/A converter 96. The output from the waveform generation circuit 91 is supplied to the digital filter circuit 92.

A series of operations of the overall electronic musical instrument 100 will be described below.

The CPU 5 comprises a microprocessor, and performs various kinds of operation control of the entire apparatus in accordance with a program pre-stored in the ROM 6.

The ROM 6 is a program memory for the CPU 5, and prestores a program for determining the operation of the CPU 5.

The ROM 6 also stores tone color parameters, a tone color control table based on key touch data, and the like.

The tone color parameters include parameters for designating the output waveform of the waveform generation circuit 91, parameters for designating the resonant frequency of the digital filter circuit 92 and a Q factor indicating the filter roll-off or slope characteristics, i.e., the sharpness of the peak and root of the frequency characteristic curve, parameters for controlling an envelope signal output from the amplitude envelope generation circuit 94, and the like.

The RAM 7 is a work memory for the CPU 5, and is used for temporarily storing the processing contents upon executing various kinds of processing by the CPU 5.

The RAM 7 also stores the current state data of the panel circuit 4, and the like.

The keyboard circuit 2 has two switches per key (not shown), and these switches have a matrix circuit arrangement via diodes.

The key scan/touch detection circuit 3 scans the states of the individual switches of the keyboard circuit 2 to detect key-ON and key-OFF events in correspondence with changes in state of the switches, and to detect the key-ON strength (touch).

The key scan/touch detection circuit 3 supplies, to the CPU 5, the detection results of the key-ON and key-OFF events as key data, and the detection result of the key-ON touch as touch data.

The panel circuit 4 has a tone color selection switch, effect selection switch, tone volume setting switch, and the like (which are not shown), and the states of these switches are read by the CPU 5.

The operation of the damper pedal 1 is read by the CPU 5 as ON/OFF data of a switch.

Accordingly, the CPU 5 controls the operations of the overall apparatus on the basis of the key data and touch data of the keyboard circuit 2 detected by the key scan/touch detection circuit 3, the states of the switches of the panel circuit 4, the ON/OFF state of the damper pedal 1, and the like, and supplies data stored in the ROM 6 to the tone generation circuit 9 via the interface circuit 8.

The interface circuit 8 comprises a synchronization circuit, and the like, and makes data transfer from the CPU 5 to the tone generation circuit 9 synchronize with the operation timing of the tone generation circuit 9.

More specifically, when data transfer from the CPU 5 to the tone generation circuit 9 is performed, the interface circuit 8 supplies data output from the CPU 5 onto the bus line 10 to the tone generation circuit 9 via the data bus CID in synchronism with the operation timing of the tone generation circuit 9.

Also, the interface circuit 8 supplies a forced transition signal Wf for requesting forced phase transition (to be described later) and a clear signal Clf for clearing a request signal RQf from the amplitude envelope generation circuit 94 in accordance with an instruction from the CPU 5.

The waveform generation circuit 91 comprises a phase accumulator, waveform memory, sample interpolation circuit, and the like, although not shown, and time-divisionally generates tone signals GWD for a plurality of channels in accordance with an instruction from the CPU 5.

The digital filter circuit 92 performs digital filter calculations for the tone signals GWD from the waveform generation circuit 91 using the filter characteristics designated by the CPU 5, thus time-divisionally generating tone signals FWD.

The amplitude envelope generation circuit 94 time-divisionally generates amplitude envelope signals Ec for a plurality of channels on the basis of data transferred from the CPU 5.

The multiplier 93 calculates the products of the tone signals FWD from the digital filter circuit 92 and the amplitude envelope signals Ec from the amplitude envelope generation circuit 94, and time-divisionally supplies the products to the accumulation circuit 95.

The accumulation circuit 95 accumulates the products for a plurality of channels, time-divisionally supplied from the multiplier 93 to synthesize the products for all the channels, thereby generating a digital tone signal.

The D/A converter 96 converts the digital tone signal obtained by the accumulation circuit 95 into an analog signal, and supplies it to the sound system 97.

The sound system 97 comprises an amplifier, a loudspeaker, and the like (not shown), and outputs the sound of the tone signal supplied from the D/A converter 96.

The series of operations of the overall electronic musical instrument 100 have been described.

The CPU 5 will be described in detail below.

The CPU 5 supplies data stored in the ROM 6 to the tone generation circuit 9 via the interface circuit 8. The ROM 6 stores, as the data, for example, a pointer table Ta, a waveform address table Tb, a parameter table Tc, and the like.

The pointer table Ta is a table stored as one of the tone color parameters, and is made up of waveform numbers Wn to be used and parameter numbers Pn to be used corresponding to N key numbers Kn, as shown in FIG. 2.

The pointer table Ta is looked up in the tone generation start processing of the CPU 5.

The waveform address table Tb is a table stored as one tone color parameter, and is made up of addresses Wa corresponding to M waveform numbers Wn, as shown in FIG. 3.

Each address Wa includes a start address ST, a loop-top address LT, and a loop-end address LE, which indicate the addresses of a waveform memory of the waveform generation circuit 91.

The waveform address table Tb is looked up in the tone generation start processing of the CPU 5. With this table, the waveform address data corresponding to an ON key is supplied to the waveform generation circuit 91 to control the waveform of the tone signal GWD to be output from the waveform generation circuit 91.

The parameter table Tc is a table stored as one tone color parameter, and is made up of parameters Pv corresponding to L parameter numbers Pn, as shown in FIG. 4.

Each parameter Pv includes an attack speed AS, attack level AL, decay 1 speed D1S, decay 1 end value D1E, decay 2 speed D2S, and release speed RS.

Note that, for example, the digital filter circuit 92 has the characteristics of a low-pass filter, and the resonant frequency substantially corresponds to the cutoff frequency of the low-pass filter.

In this electronic musical instrument 100, the filter characteristics of the digital filter circuit 92 are controlled by changing the resonant frequency and the Q factor.

Hence, the parameter Pv also includes a resonant frequency bias $\omega_0$B and Q-bias QB.

As described above, each parameter Pv represents parameters for designating the resonant frequency and Q of the digital filter circuit 92, parameters for controlling an envelope signal output from the amplitude envelope generation circuit 92, and the like.

The parameter table Tc is looked up in the tone generation start processing of the CPU 5. Of the parameters looked up at that time, i.e., of those corresponding to the ON key, some parameters for controlling the envelope signal output from the amplitude envelope generation circuit 94 are temporarily stored in the RAM 7.

The remaining parameters are supplied to the digital filter circuit 92 and the amplitude envelope generation circuit 94, thereby controlling the filter characteristics of the digital filter circuit 92 and the envelope signal output from the amplitude envelope generation circuit 94.

Figure 5:
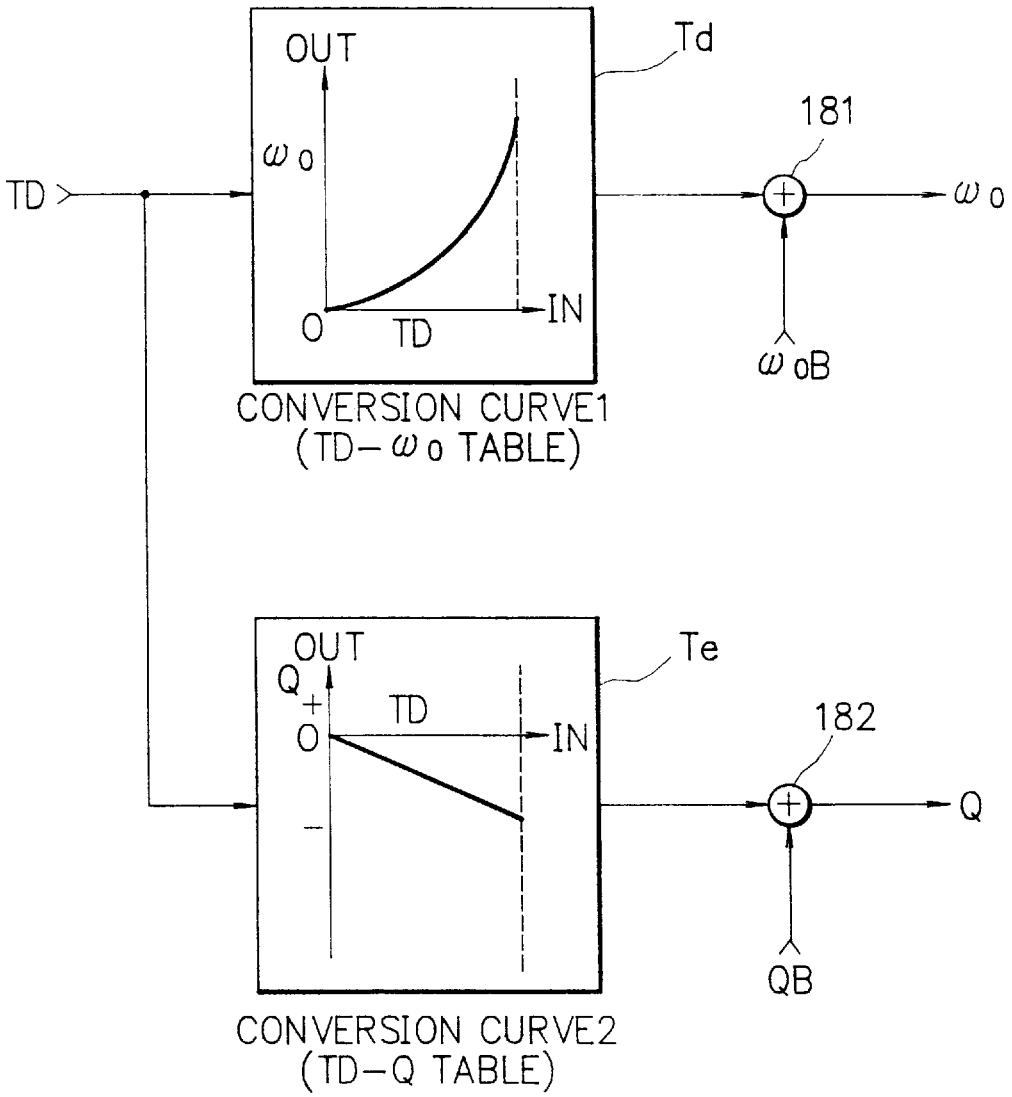
FIG. 5 is a flow graph for explaining the filter characteristic control processing of a CPU.

The ROM 6 stores the above-mentioned pointer table Ta, waveform address table Tb, and parameter table Tc, and also stores a TD-$\omega_0$ table Td and a TD-Q table Te, as shown in FIG. 5.

The CPU 5 arbitrarily changes the filter characteristics of the digital filter circuit 92 in accordance with key touch data using the TD-$\omega_0$ table Td and TD-Q table Te stored in the ROM 6.

More specifically, the CPU 5 reads out a resonant frequency bias value (or base value) $\omega_0$B and Q-bias value (or base value) QB corresponding to an ON key from the parameter table Tc on the basis of the key data supplied from the key scan/touch detection circuit 3.

Subsequently, the CPU 5 converts touch data TD supplied from the key scan/touch detection circuit 3 using the TD-$\omega_0$ table Td, as shown in FIG. 5, and adds the converted data and the resonant frequency bias $\omega_0$B read out from the parameter table To using an adder 181. The CPU 5 then determines the sum output of the adder 181 as a resonant frequency $\omega_0$.

Also, the CPU 5 converts the touch data TD supplied from the key scan/touch detection circuit 3 using the TD-Q table Te, and adds the converted data and the Q-bias QB read out from the parameter table Tc using an adder 182. The CPU 5 then determines the sum output of the adder 182 as the Q factor.

Thereafter, the CPU 5 supplies the determined resonant frequency $\omega_0$ and Q factor to the digital filter circuit 92 via the interface circuit 8.

Figure 6:
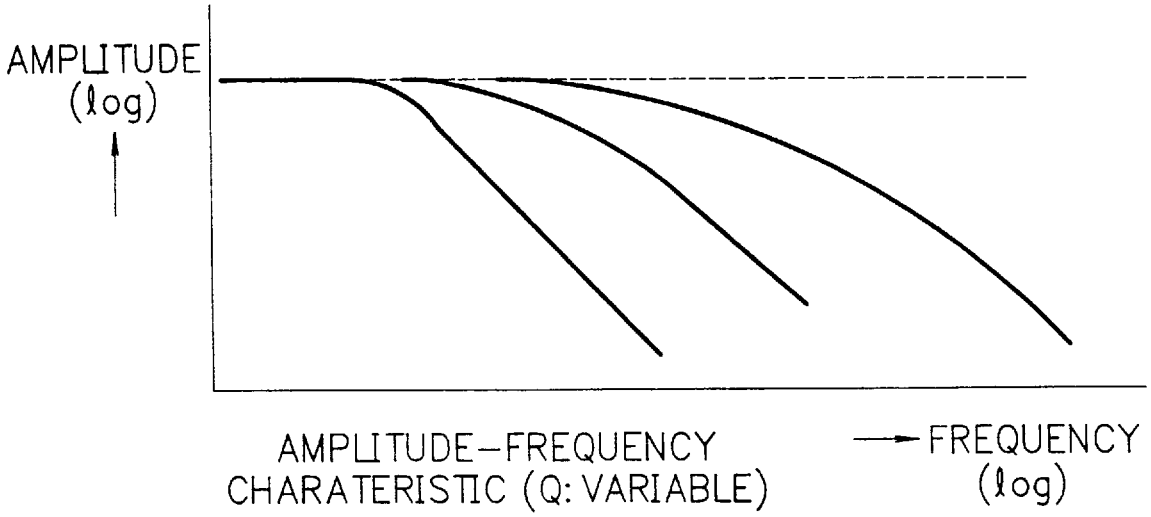
FIG. 6 is a graph for explaining the filter characteristics of a digital filter circuit.

Accordingly, the filter characteristics of the digital filter circuit 92 are controlled to have, e.g., amplitude-frequency characteristics, as shown in FIG. 6.

Note that FIG. 6 shows the amplitude-frequency characteristics when the Q factor is smaller than "1" in linear expression.

The amplitude envelope signal control processing in the CPU 5 will be described in detail later.

The digital filter circuit 92 will be described in detail below.

Figure 7:
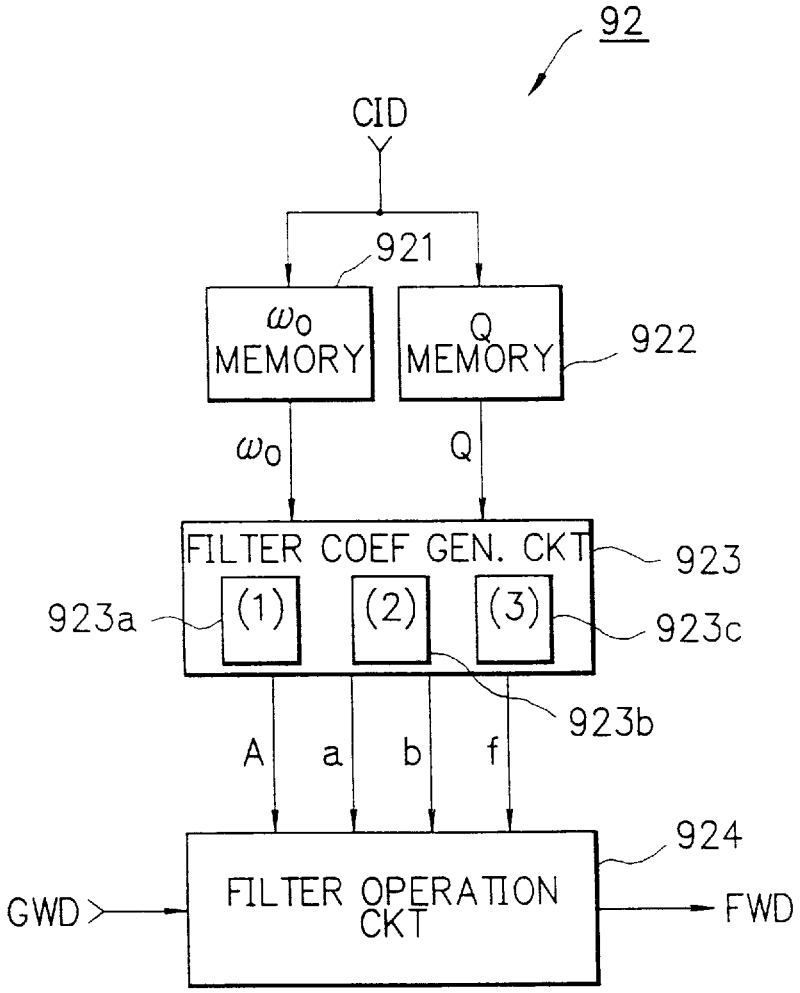
FIG. 7 is a block diagram showing the arrangement of the digital filter circuit.

As shown in FIG. 7, the digital filter circuit 92 comprises a resonant frequency $\omega_0$ memory 921 which receives the resonant frequency $\omega_0$ from the CPU 5, a Q factor memory 922 which receives the Q factor from the CPU 5, a filter coefficient generation circuit 923 which receives the outputs from the memories 921 and 922, and a filter operation circuit 924 which receives the output from the filter coefficient generation circuit 923 and tone signals GWD supplied from the waveform generation circuit 91. The output from the filter operation circuit 924 is supplied to the multiplier 93.

The resonant frequency $\omega_0$ memory (to be referred to as an $\omega_0$ memory hereinafter) 921 comprises, e.g., a RAM having the same number of words as the number of tone generation channels, and stores resonant frequencies $\omega_0$ from the CPU 5 in units of channels.

The $\omega_0$ memory 921 time-divisionally supplies the stored resonant frequencies $\omega_0$ to the filter coefficient generation circuit 923.

The Q factor memory (to be referred to as a Q memory hereinafter) 922 comprises, e.g., a RAM having the same number of words as the number of tone generation channels, and stores Q factors from the CUP 5 in units of channels.

The Q memory 922 time-divisionally supplies the stored Q factors to the filter coefficient generation circuit 923.

The filter coefficient generation circuit 923 generates filter coefficients A, a, b, and f on the basis of the resonant frequency $\omega_0$ from the $\omega_0$ memory 921 and the Q factor from the Q memory 922, and supplies these coefficients to the filter operation circuit 924.

The digital filter according to this embodiment has the following transfer function which is obtained by bilinear transform from a transfer function of a second-order analog low-pass filter:

$$H(z) = \frac{a(1 + 2z^{-1} + z^{-2})}{1 + b + 2(A - 1)z^{-1} + (1 - b)z^{-2}}$$

where, $A=1-\cos\omega_0$ $a=A/2Q$ (for $Q \geqq 1$)

$a=A/2$ (for $Q<1$)

$b=(\sin\omega_0)/2Q$.

The coefficient a is determined such that the maximum value of the amplitude-frequency characteristic of the filter becomes nearly 1.

$\omega_0$ is a resonant frequency expressed by normalization based on a sampling frequency, ranging:

$$0<\omega_0<\pi$$

Q is a quality factor determined by filter design.

With f=b/(1+b), H(z) can be written as:

$$H(z) = \frac{a(1 + 2z^{-1} + z^{-2})}{(1 - f)^{-1} + 2(A - 1)z^{-1} + (1 - b)z^{-2}}$$

wherein f(b)=b/(1+b) can be calculated by approximation.

The filter coefficient generation circuit 923 comprises, e.g., three circuits, i.e., a first circuit 923*a*, second circuit 923*b*, and third circuit 923*c*.

Figure 8:
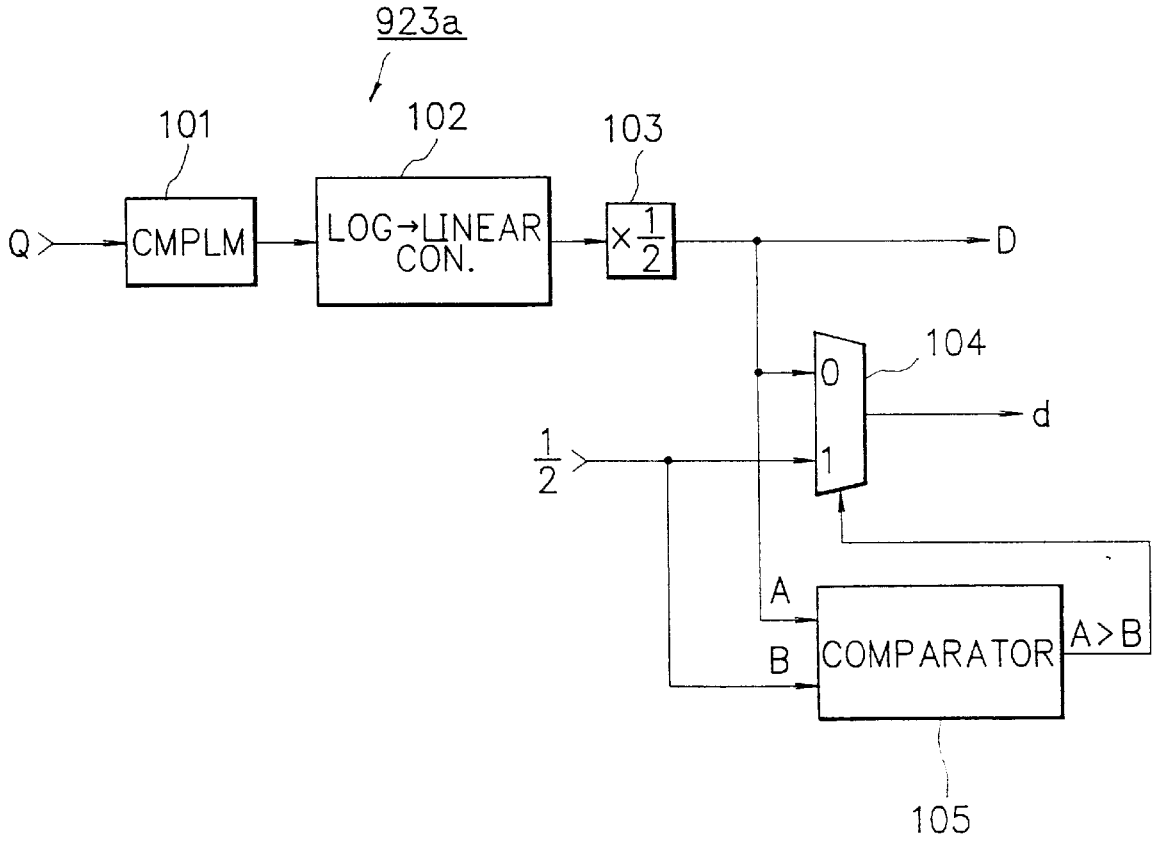
FIG. 8 is a block diagram showing the arrangement of the first circuit of a filter coefficient generation circuit in the digital filter circuit.

As shown in FIG. 8, the first circuit 923*a* comprises a complement circuit 101 which receives the Q factor from the Q memory 922, a log/linear conversion circuit 102 which receives the output from the complement circuit 101, a 1-bit right shift circuit 103 which receives the output from the log/linear conversion circuit 102, and a selector 104 and a comparator 105 which respectively receive an output D from the 1-bit right shift circuit 102 and a predetermined value (="½"). The output from the comparator 105 is supplied to the selector 104.

The output D from the 1-bit right shift circuit 103, and an output d from the selector 104 are supplied to the second circuit 923*b*.

The comparator 105 compares the output D from the 1-bit right shift circuit 103 with the predetermined value (="½"), and supplies the comparison result to the selector 104.

The selector 104 selects one of the output D from the 1-bit right shift circuit 103 and the predetermined value (="½") on the basis of the comparison result from the comparator 105.

Accordingly, the first circuit 923*a* supplies to the second circuit 923*b* the output D (=1/(2Q)) from the 1-bit right shift circuit 103 (½ divider), and the output d having a value "d=1/(2Q)" of the selector 104 when Q is equal to or larger than "1" ($Q \geqq 1$ or $D \leqq ½$); or the output d having a value "d=½" of the selector 104 when Q is smaller than "1" ($Q<1$ or $D>½$).

Figure 9:
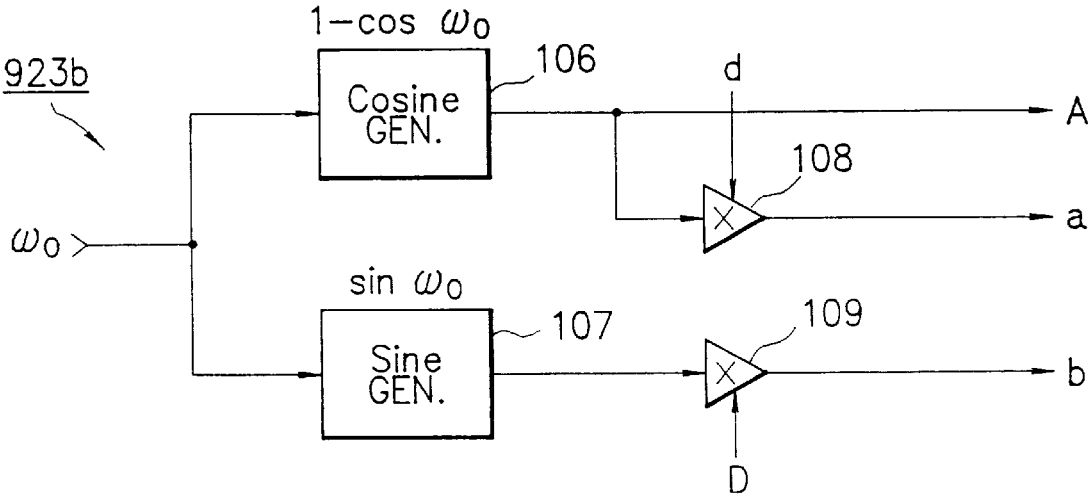
FIG. 9 is a block diagram showing the arrangement of the second circuit of the filter coefficient generation circuit in the digital filter circuit.

As shown in FIG. 9, the second circuit 923*b* comprises a Cosine generator 106 and a Sine generator 107 which receive the resonant frequency $\omega_0$ from the $\omega_0$ memory 921, a multiplier 108 which receives the output from the Cosine generator 106, and a multiplier 109 which receives the output from the Sine generator 107. The output from the Cosine generator 106, the output from the multiplier 108, and the output from the multiplier 109 are supplied as the filter coefficients A, a, and b to the filter operation circuit 924 shown in FIG. 7, and the output (=filter coefficient b) from the multiplier 109 is also supplied to the third circuit 923*c*.

The Cosine generator 106 comprises a ROM table and its interpolation circuit, although not shown. The Cosine generator 106 supplies a value "$1-\cos\omega_0$" obtained from the resonant frequency $\omega_0$ from the $\omega_0$ memory 921 to the filter operation circuit 924 as the filter coefficient A, and also supplies the filter coefficient A to the multiplier 108.

The multiplier 108 multiplies the output d from the first circuit 923*a* by the filter coefficient A from the Cosine generator 106, and supplies the product as the filter coefficient a to the filter operation circuit 924.

The Sine generator 107 comprises a ROM table and its interpolation circuit, although not shown, and supplies a value "$\sin\omega_0$" obtained from the resonant frequency $\omega_0$ from the $\omega_0$ memory 921 to the multiplier 109.

The multiplier 109 multiplies the output D from the first circuit 923*a* by the output (=$\sin\omega_0$) from the Sine generator 107, and supplies the product as the filter coefficient b to the filter operation circuit 924 and the third circuit 923*c*.

Figure 10:
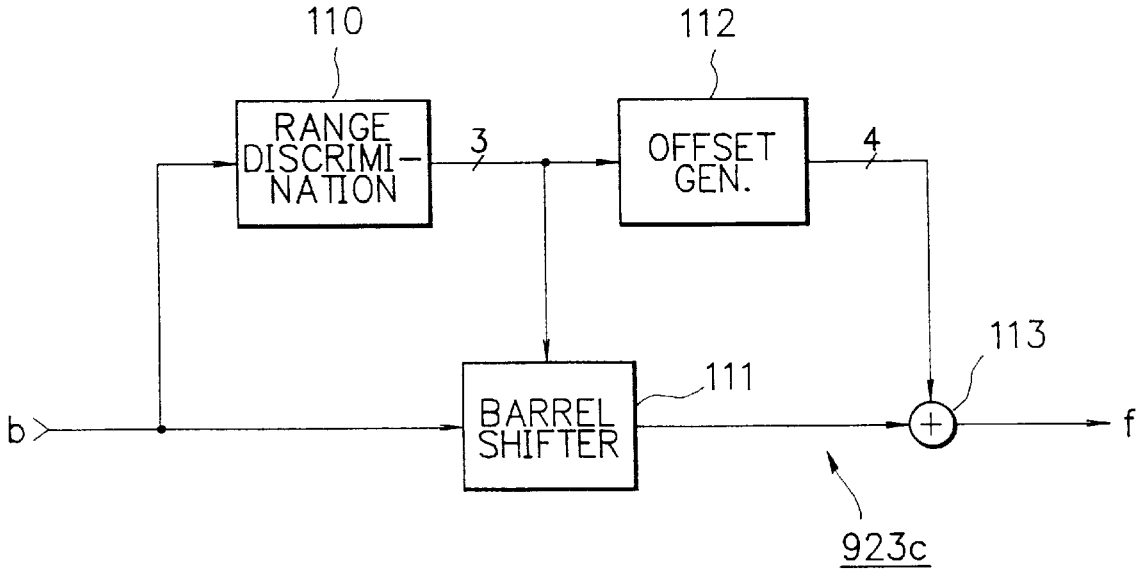
FIG. 10 is a block diagram showing the arrangement of the third circuit of the filter coefficient generation circuit in the digital filter circuit.

The third circuit 923*c* is made up of a polygonal line approximation circuit, and comprises a range discrimination circuit 110 and a barrel shifter 111, which receive the filter coefficient b from the second circuit 923*b*, an offset generation circuit 112 which receives the output from the range discrimination circuit 110, and an adder 113 which receives the outputs from the barrel shifter 111 and the offset generation circuit 112, as shown in FIG. 10. The output from the range discrimination circuit 110 is also supplied to the barrel shifter 111.

The output from the adder 113 is supplied to the filter operation circuit 924 shown in FIG. 7 as the filter coefficient f.

The range discrimination circuit 110 is a kind of encoder that generates 3-bit range data on the basis of the upper 4 bits of the filter coefficient b supplied from the second circuit 923*b*, and supplies 3-bit range data corresponding to the filter coefficient b to the offset generation circuit 112 and the barrel shifter 111 in accordance with Table 1.

TABLE 1

| Range of Input b | Value of Input b (X = don't care) | Output Value |
|---|---|---|
| $0 \leqq b < 1/4$ | (0000) | 0 (000) |
| $1/4 \leqq b < 1/2$ | (0001) | 1 (001) |
| $1/2 \leqq b < 3/2$ | (001X) (010X) | 2 (010) |
| $3/2 \leqq b < 2$ | (011X) | 3 (011) |
| $2 \leqq b < 4$ | (1XXX) | 4 (100) |

Binary notation in parenthesis

The barrel shifter 111 shifts the filter coefficient b from the second circuit 923*b* to the right (division of the power of 2) based on the 3-bit range data from the range discrimination circuit 110 in accordance with Table 2, and supplies the result to the adder 113.

TABLE 2

| Input Value | Output Value |
|---|---|
| 0 (000) | b |
| 1 (001) | b/2 |
| 2 (010) | b/4 |
| 3 (011) | b/8 |
| 4 (100) | b/16 |

Binary notation in parenthesis

The offset generation circuit 112 generates a 4-bit offset value based on the 3-bit range data from the range discrimination circuit 110 in accordance with Table 3, and supplies it to the adder 113.

TABLE 3

| Input Value | Output Value |
|---|---|
| 0 (000) | 0 (0000) |
| 1 (001) | 2/16 (0010) |
| 2 (010) | 4/16 (0100) |
| 3 (011) | 7/16 (0111) |
| 4 (100) | 9/16 (1001) |

Binary notation in parenthesis

The adder 113 adds the outputs from the barrel shifter 111 and the offset generation circuit 112, and supplies the sum as the coefficient f to the filter operation circuit 924 receives Accordingly, the filter operation circuit 924 receives the polygonal-line approximated filter coefficient f.

That is a value obtained by approximation of:

$$f(b)=b/(1-b)$$

within the range "$0 \leqq b<4$" to:

| | |
|---|---|
| $f(b) \approx b$ | $(0 \leqq b < 1/4)$ |
| $f(b) \approx (b/2) + (2/16)$ | $(1/4 \leqq b < 1/2)$ |
| $f(b) \approx (b/4) + (4/16)$ | $(1/2 \leqq b < 3/2)$ |
| $f(b) \approx (b/8) + (7/16)$ | $(3/2 \leqq b < 2)$ |
| $f(b) \approx (b/16) + (9/16)$ | $(2 \leqq b < 4)$ |

is supplied as the filter coefficient f to the filter operation circuit 924.

Figure 11:
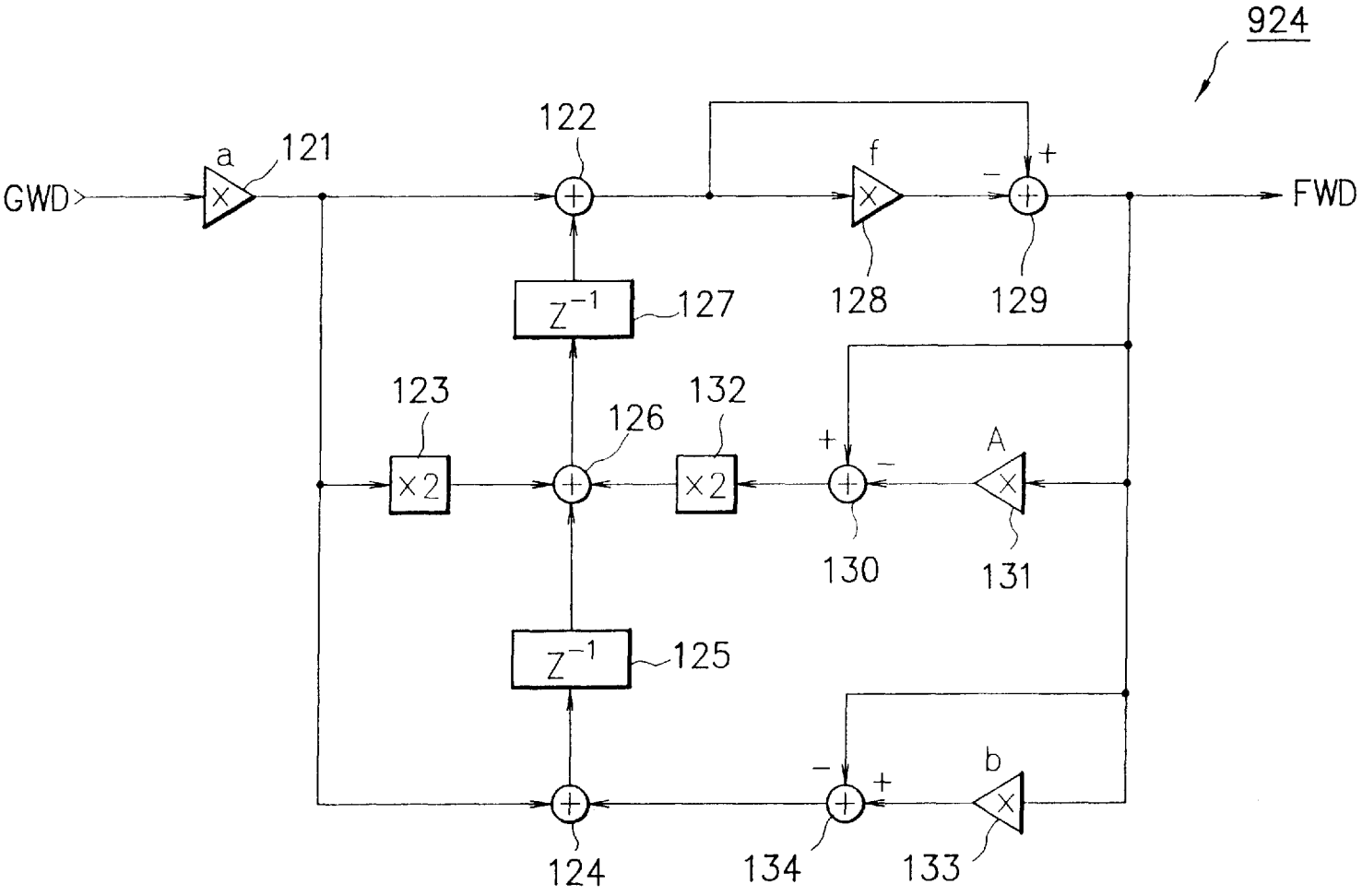
FIG. 11 is a block diagram showing the arrangement of a filter operation circuit in the digital filter circuit.

As shown in FIG. 11, the filter operation circuit 924 comprises a multiplier 121 which receives a tone signal GWD from the waveform generation circuit 91 shown in FIG. 1, an adder 122, 1-bit left shift circuit 123, and an adder 124, which receive the output from the multiplier 121, a multiplier 128 which receives the output from the adder 122, and an adder 129 which receives the output from the multiplier 128. The output from the adder 122 is also supplied to the adder 129, whose output is supplied as a tone waveform FWD to the multiplier 93 shown in FIG. 1.

The filter operation circuit 924 comprises a 1-sample delay memory 125 which receives the output from the adder 124, an adder 126 which receives the outputs from the 1-bit left shift circuit 123 (×2 multiplier) and the 1-sample delay memory 125, and a 1-sample delay memory 127 which receives the output from the adder 126. The output from the 1-sample delay memory 127 is supplied to the adder 122.

Furthermore, the filter operation circuit 924 comprises multipliers 131 and 133 which receive the output from the adder 129, an adder 130 which receives the outputs from the adder 129 and the multiplier 131, a 1-bit left shift circuit 132 which receives the output from the adder 130, and an adder 134 which receives the outputs from the adder 129 and the multiplier 133. The output from the 1-bit left shift circuit 132 (×2 multiplier) is supplied to the adder 126, and the output from the adder 134 is supplied to the adder 124.

The multiplier 121 multiplies a tone signal GWD from the waveform generation circuit 91 by the filter coefficient a obtained by the filter coefficient generation circuit 923, and the multiplier 128 multiplies the output from the adder 122 by the filter coefficient f obtained by the filter coefficient generation circuit 923.

The multiplier 131 multiplies a tone waveform FWD as the output from the adder 129 by the filter coefficient A obtained by the filter coefficient generation circuit 923, and the multiplier 133 multiplies a tone waveform FWD as the output from the adder 129 by the filter coefficient b obtained by the filter coefficient circuit 923.

Each of the 1-sample delay memories 125 and 127 comprises a RAM having the same number of words as the number of tone generation channels, and gives a delay amount for one sample required for digital filter calculations to an input signal.

With the above-mentioned arrangement, the filter operation circuit 924 performs filter calculations for a tone signal GWD from the waveform generation circuit 91.

As described above, the digital filter circuit 92 performs filter calculations for a tone signal GWD from the waveform generation circuit 91 using the filter characteristics which are arbitrarily changed by the CPU 5 in correspondence with the key touch data, and supplies the tone signal GWD subjected to the filter calculations to the multiplier 93 as a tone signal FWD.

The multiplier 93 also receives the output from the amplitude envelope generation circuit 94.

The amplitude envelope generation circuit 94 will be described in detail below.

Figure 12:
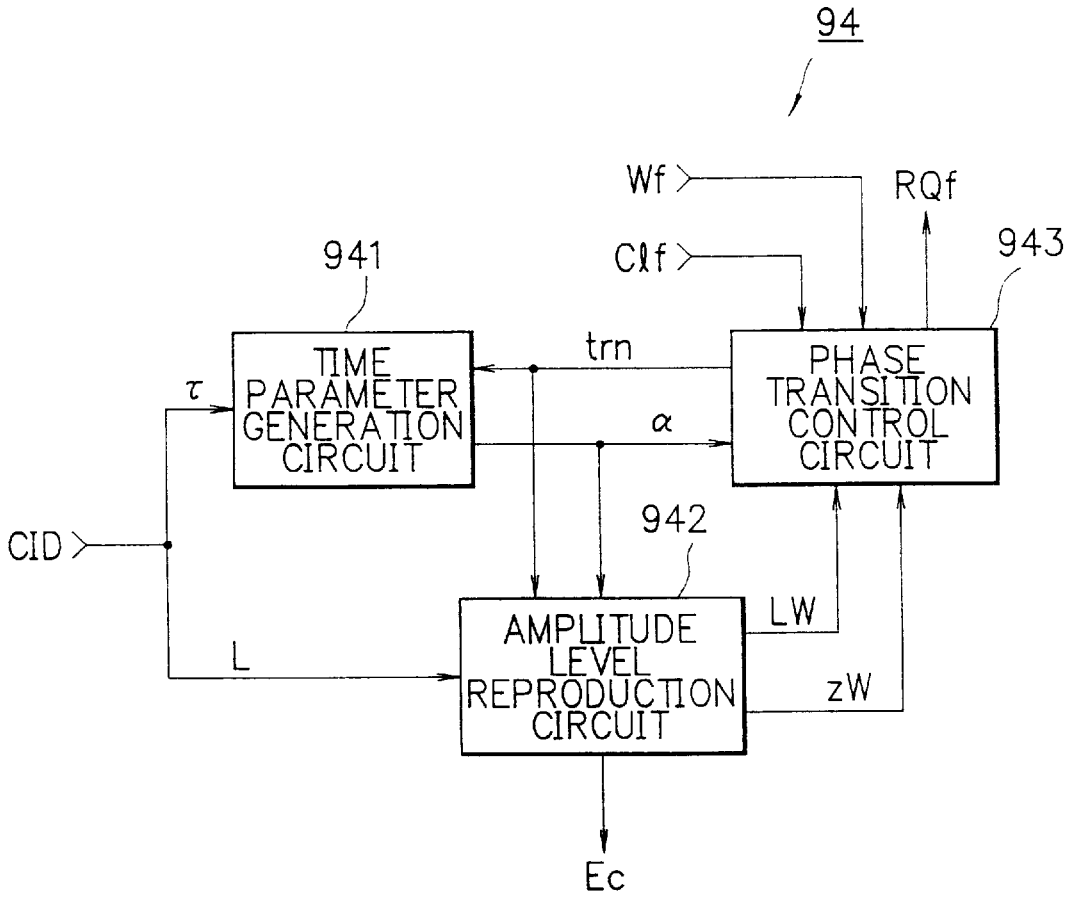
FIG. 12 is a block diagram showing the arrangement of an amplitude envelope generation circuit.

As shown in FIG. 12, the amplitude envelope generation circuit 94 comprises a time parameter generation circuit 941 and an amplitude level reproduction circuit 942 which receive the parameters from the CPU 5, and a phase transition control circuit 943 connected to the amplitude level reproduction circuit 942. The outputs from the time parameter generation circuit 941 and the phase transition control circuit 943 are supplied to the amplitude level reproduction circuit 942, whose output is supplied to the phase transition control circuit 943.

The phase transition control circuit 943 receives the forced transition signal Wf and the clear signal C1f output from the interface circuit 8 in accordance with an instruction from the CPU 5.

Furthermore, the parameter request signal RQf output from the phase transition control circuit 943 is supplied to the interface circuit 8, and the output from the amplitude level reproduction circuit 942 is supplied to the multiplier 93.

The time parameter generation circuit 941 generates a time parameter $\alpha$ which is normalized by a parameter $\tau$ associated with the speed and supplied from the CPU 5, and supplies it to the phase transition control circuit 943 and the amplitude level reproduction circuit 942.

This parameter $\tau$ contributes to determination of the phase time of the amplitude envelope, and corresponds to the attack speed AS, the decay speed D1S or D2S and the release speed RS in the parameter table Tc in FIG. 4.

Figure 13:
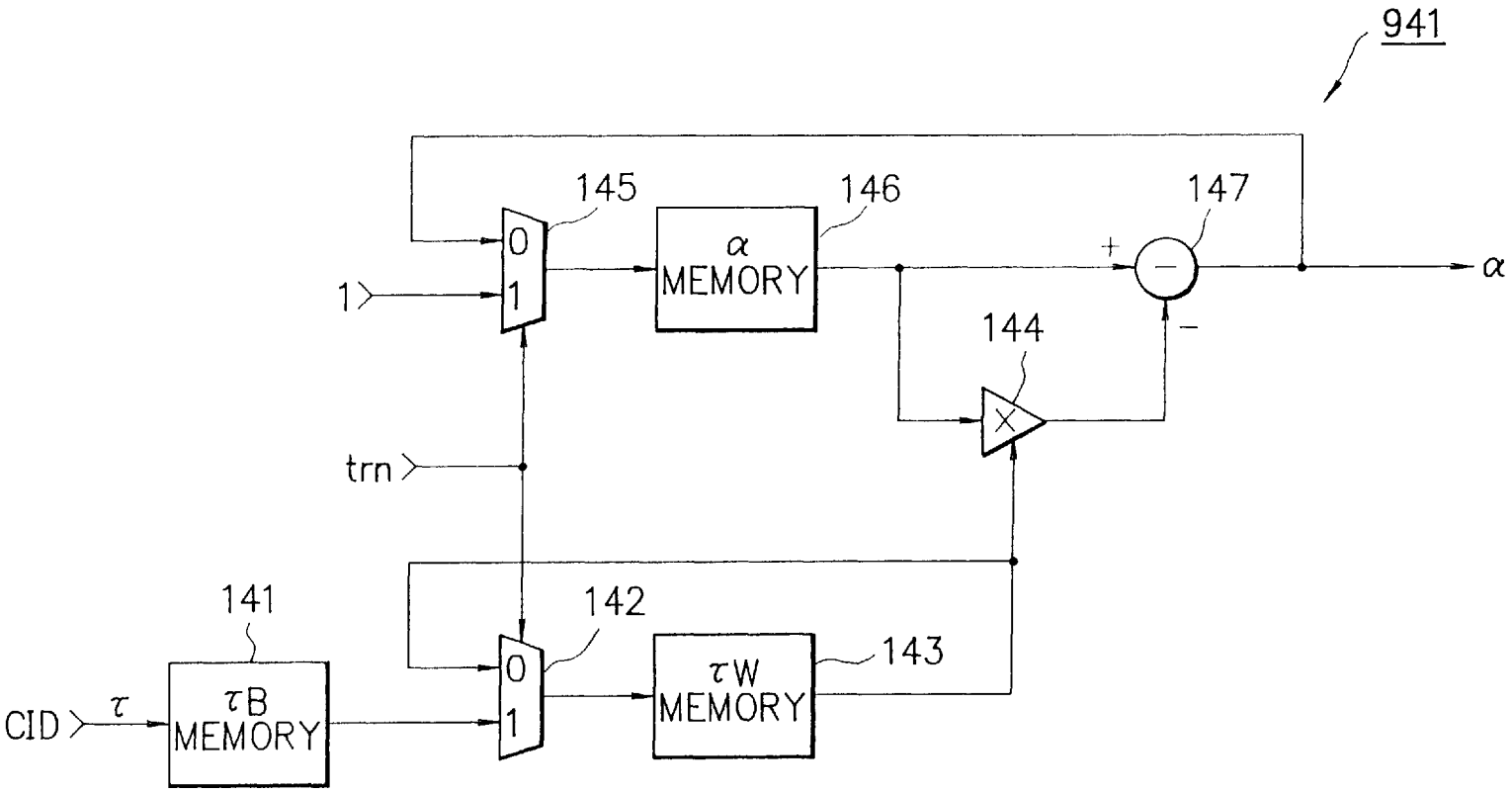
FIG. 13 is a block diagram showing the arrangement of a time parameter generation circuit in the amplitude envelope generation circuit.

More specifically, the time parameter generation circuit 941 comprises a parameter $\tau$ memory 141 which receives the parameter $\tau$ from the CPU 5, a selector 142 which receives the output from the memory 141 and a phase transition signal trn from the phase transition control circuit 943, and a parameter τ memory 143 which receives the output from the selector 142, and a multiplier 144 which receives the output from the memory 143, as shown in FIG. 13. The output from the memory 143 is also supplied to the selector 142.

Also, the time parameter generation circuit 941 comprises a selector 145 which receives the phase transition signal trn from the phase transition control circuit 943 and a predetermined value "1", a time parameter α memory 146 which receives the output from the selector 145, and a subtracter 147 which receives the output from the memory 146. The output from the memory 146 is also supplied to the multiplier 144, and the output from the subtracter 147 is supplied to the selector 145, the phase transition control circuit 943, and the amplitude level reproduction circuit 942.

The parameter τ memory (to be referred to as a τB memory hereinafter) 141 comprises, e.g., a RAM having the same number of words as the number of tone generation channels, and stores parameters τ supplied from the CPU 5 and used in the next phase in units of channels as parameters τB.

The parameter τ memory (to be referred to as a τW memory hereinafter) 143 comprises, e.g., a RAM having the same number of words as the number of tone generation channels, and stores parameters output from the selector 142 in units of channels as parameters τW.

The selector 142 receives the parameters τB stored in the τB memory 141 and the parameters τW stored in the τW memory 143, and supplies the parameters τB stored in the τB memory 141 to the τW memory 143 when the phase transition signal trn from the phase transition control circuit 943 becomes "true" (="1").

Accordingly, the τW memory 143 stores the parameters τB as the parameters τW to be used in the current phase.

Note that the phase transition signal trn output from the phase transition control circuit 943 becomes "true" in response to the forced transition signal Wf that requests forced phase transition in accordance with an instruction from the CPU 5, and a detailed description thereof will be made later.

On the other hand, the time parameter α memory (to be referred to as an a memory hereinafter) 146 comprises, e.g., a RAM having the same number of words as the number of tone generation channels, and stores time parameters α from the selector 145 in units of channels.

The multiplier 144 multiplies the time parameter α stored in the a memory 146 by the parameter τW stored in the τW memory 143 and used in the current phase, and supplies the product to the subtracter 147.

The subtracter 147 subtracts the product from the multiplier 144 from the time parameter α stored in the α memory 146, and outputs the difference as a time parameter α.

The selector 145 receives the predetermined value "1" and the time parameter α output from the subtracter 147. When the phase transition signal trn from the phase transition control circuit 943 becomes "false" (="0"), the selector 145 supplies the time parameter α from the subtracter 147 to the a memory 146; when the phase transition signal trn from the phase transition control circuit 943 becomes "true" (="1"), the selector 145 supplies the predetermined value "1" to the α memory 146.

Accordingly, the α memory 146 stores the current value of the normalized time parameter α, which is, for example, written:

$$\alpha(n)=\alpha(n-1)-\alpha(n-1).\ \tau W$$

The time parameter a is initialized to "1" when the phase transition signal trn becomes "true" (="1").

The time parameter α obtained by the time parameter generation circuit 941 as described above is supplied to the amplitude level reproduction circuit 942 and the phase transition control circuit 943.

The amplitude level reproduction circuit 942 reproduces the amplitude level of the amplitude envelope on the basis of a parameter L from the CPU 5 and the time parameter α from the time parameter generation circuit 941, and supplies the current value of the amplitude envelope to the multiplier 93 as an amplitude envelope signal Ec.

The parameter L is given by modifying the attack level parameter AL from the parameter table Tc in FIG. 4 in response to key touch data during attack phase, and also is given a value of the decay 1 end parameter D1E from the parameter table Tc in FIG. 4 during decay phase.

At this time, one of the parameter L and "0" is selected as a target level in accordance with a parameter z from the CPU 5. The parameter z gives meaning of the parameter L such that the parameter L is to be used as a target level of the amplitude envelope control when z is set "0" (false), and the parameter L is to be used as a value at termination of time parameter α with the target level being 0 (zero) when z is set "1" (true).

The amplitude level reproduction circuit 942 supplies parameters LW and zW supplied from the CPU 5 and used in the current phase to the phase transition control circuit 943.

Figure 14:
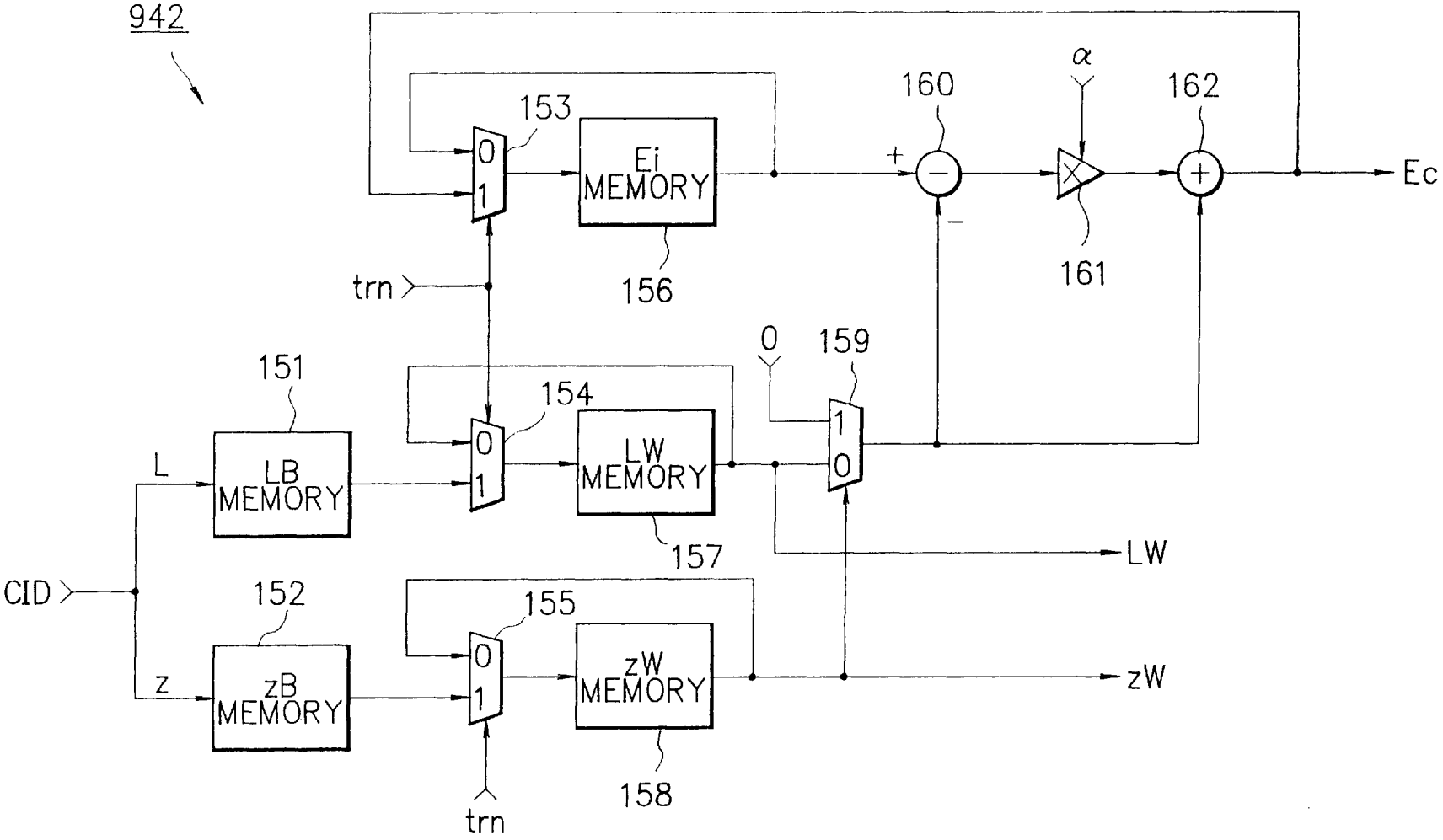
FIG. 14 is a block diagram showing the arrangement of an amplitude level reproduction circuit in the amplitude envelope generation circuit.

More specifically, as shown in FIG. 14, the amplitude level reproduction circuit 942 comprises a parameter L memory 151 and a parameter z memory 152 which receive parameters from the CPU 5, a selector 155 which receives the output from the memory 152 and the phase transition signal trn from the phase transition control circuit 943, and a parameter z memory 158 which receives the output from the selector 155. The output from the memory 158 is output as a parameter zW, and is also supplied to the selector 155 and a selector 159 (to be described later).

Also, the amplitude level reproduction circuit 942 comprises a selector 154 which receives the output from the memory 151 and the phase transition signal trn from the phase transition control circuit 943, a parameter L memory 157 which receives the output from the selector 154, and the selector 159 which receives the outputs from the memories 157 and 158, and a predetermined value "0". The output from the memory 157 is output as a parameter LW, and is also supplied to the selector 154.

Furthermore, the amplitude level reproduction circuit 942 comprises a selector 153 which receives the phase transition signal trn from the phase transition control circuit 943, an amplitude envelope initial value Ei memory 156 which receives the output from the selector 153, a subtracter 160 which receives the outputs from the memory 156 and the selector 159, a multiplier 161 which receives the output from the subtracter 160 and the time parameter α from the time parameter generation circuit 941, and an adder 162 which receives the outputs from the multiplier 161 and the selector 159. The output from the adder 162 is output as an amplitude envelope signal EC, and is also supplied to the selector 153. The selector 153 also receives the output from the memory 156.

The parameter z memory (to be referred to as a zB memory hereinafter) 152 comprises, e.g., a RAM having the same number of words as the number of tone generation channels, and stores parameters z from the CPU 5 in units of channels as parameters zB to be used in the next phase.

The parameter z memory (to be referred to as a zW memory hereinafter) 158 comprises, e.g., a RAM having the same number of words as the number of tone generation channels, and stores parameters output from the selector 155 in units of channels as parameters zW.

The selector 155 receives the parameter zB stored in the zB memory 152 and the parameter zW stored in the zW memory 158, and supplies the parameter zB stored in the zB memory 152 to the zW memory 158 when the phase transition signal trn from the phase transition control circuit 943 becomes "true" (="1").

Accordingly, the zW memory 158 stores the parameter zB from the selector 155 as the parameter zW to be used in the current phase.

On the other hand, the parameter L memory (to be referred to as an LB memory hereinafter) 151 comprises, e.g., a RAM having the same number of words as the number of tone generation channels, and stores parameters L from the CPU 5 in units of channels as parameters LB to be used in the next phase.

The parameter L memory (to be referred to as an LW memory hereinafter) 157 comprises, e.g., a RAM having the same number of words as the number of tone generation channels, and stores parameters output from the selector 154 in units of channels as parameters LW.

The selector 154 receives the parameter LB stored in the LB memory 151, and the parameter LW stored in the LW memory 157, and supplies the parameter LB stored in the LB memory 151 to the LW memory 157 when the phase transition signal trn from the phase transition control circuit 943 becomes "true" (="1").

Accordingly, the LW memory 157 stores the parameter LB from the selector 154 as the parameter LW to be used in the current phase.

The amplitude envelope initial value Ei memory (to be referred to as an Ei memory hereafter) 156 comprises, e.g., a RAM having the same number of words as the number of tone generation channels, and stores the outputs from the selector 153 in units of channels as initial values Ei.

The selector 159 receives the parameter LW stored in the LW memory 157 and used in the current phase, and a predetermined value "0". The selector 159 selects one of the parameter LW and the predetermined value "0" on the basis of the parameter zW stored in the zW memory 158 and used in the current phase, and supplies the selected value to the subtracter 160 and the adder 162.

The subtracter 160 subtracts the output value from the selector 159 from the initial value Ei stored in the Ei memory 156, and supplies the difference to the multiplier 161.

The multiplier 161 multiplies the difference from the subtracter 160 by the time parameter α from the time parameter generation circuit 941, and supplies the product to the adder 162.

The adder 162 adds the product from the multiplier 161 and the output value from the selector 159, and outputs the sum as an amplitude envelope signal Ec, which is supplied to the selector 153.

The selector 153 receives the amplitude envelope signal Ec from the adder 162 and the initial value Ei stored in the Ei memory 156, and supplies the amplitude envelope signal Ec to the Ei memory 156 when the phase transition signal trn from the phase transition control circuit 943 becomes "true" (="1").

More specifically, when the phase transition signal trn from the phase transition control circuit 943 becomes "true" (="1"), the amplitude envelope signal Ec of the current phase is stored as a new initial value Ei in the Ei memory 156.

The amplitude envelope signal Ec of the current phase is given by:

$$Ec=(Ei-LW)\cdot\alpha+LW$$

where "(Ei−LW)" is the gain for the time parameter α.

The amplitude envelope signal Ec obtained by the amplitude level reproduction circuit 942 as described above is supplied to the multiplier 93 shown in FIG. 1, and the parameters LW and zW are supplied to the phase transition control circuit 943.

The phase transition control circuit 943 detects if the time parameter α from the time parameter generation circuit 941 has reached a phase end-value. When it is detected that the time parameter α from the time parameter generation circuit 941 has reached the phase end-value, the phase transition control circuit 943 supplies a phase transition signal trn to the time parameter generation circuit 941 and the amplitude level reproduction circuit 942, and also supplies a parameter request signal RQf of the next phase to the CPU 5 via the interface circuit 8.

At this time, the parameter LW can also be used as the phase end-value based on the parameter zW from the amplitude level reproduction circuit 942.

The phase transition signal trn output from the phase transition control circuit 943 becomes "true" also in response to the forced transition signal Wf from the interface circuit 8, i.e., a signal for requesting forced phase transition according to an instruction from the CPU 5.

The parameter request signal RQf output from the phase transition control circuit 943 is cleared by the clear signal C1f output from the interface circuit 8, i.e., a signal according to an instruction from the CPU 5.

Figure 15:
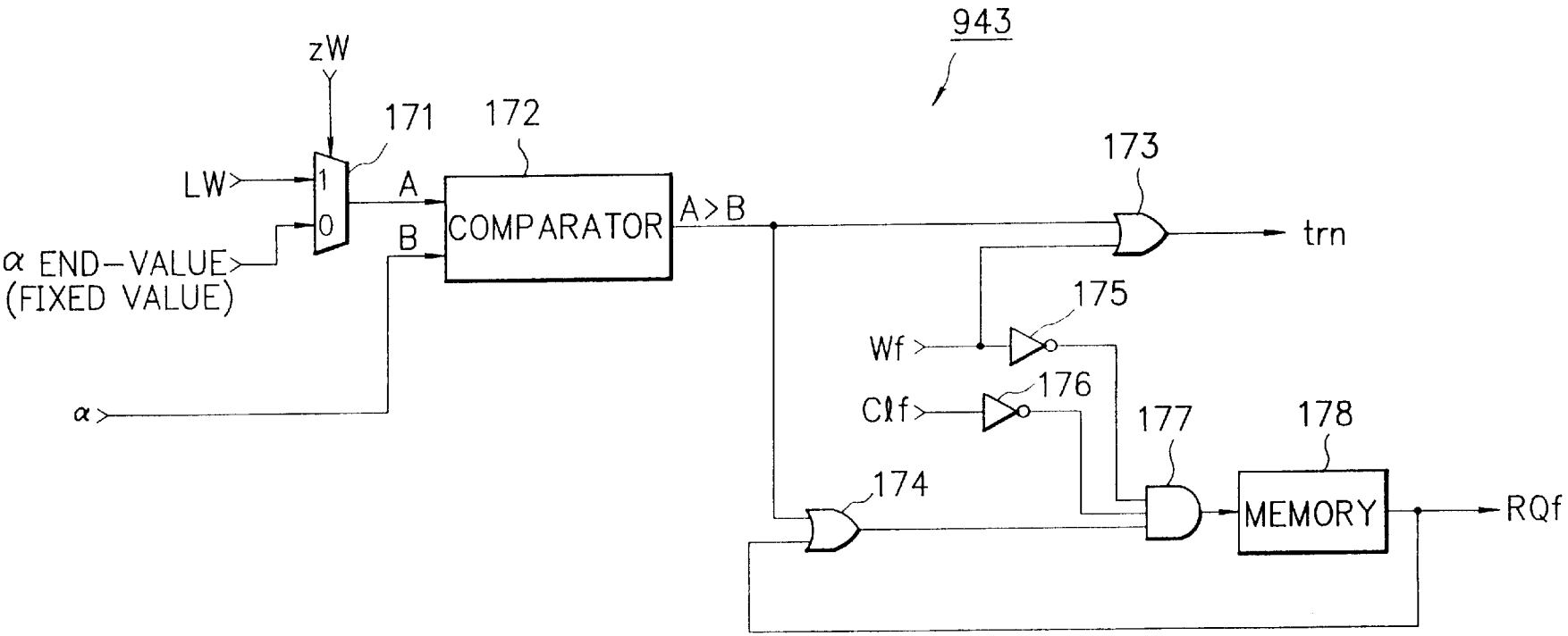
FIG. 15 is a block diagram showing the arrangement of a phase transition control circuit in the amplitude envelope generation circuit.

More specifically, as shown in FIG. 15, the phase transition control circuit 943 comprises a selector 171 which receives the parameters LW and zW from the amplitude level reproduction circuit 942, and a phase end-value (fixed value) of the time parameter α, a comparator 172 which receives the output from the selector 171 and the time parameter α from the time parameter generation circuit 941, an OR gate 173 which receives the output from the comparator 172 and the forced transition signal Wf from the interface circuit 8, a NOT gate 175 which receives the forced transition signal Wf from the interface circuit 8, a NOT gate 176 which receives the clear signal Clf from the interface circuit 8, an OR gate 174 which receives the output from the comparator 172, an AND gate 177 which receives the outputs from the NOT gates 175 and 176, and the OR gate 174, and a memory 178 which receives the output from the AND gate 177. The OR gate 174 also receives the output from the memory 178.

The output from the OR gate 173 is output as the phase transition signal trn, and the output from the memory 178 is output as the parameter request signal RQf.

When the parameter zW from the amplitude level reproduction circuit 942 is "true" (="1"), the selector 171 supplies the parameter LW from the amplitude level reproduction circuit 942 to the comparator 172 as the phase end-value; when the parameter zW from the amplitude level reproduction circuit 942 is "false" (="0"), it supplies the phase end-value (fixed value) to the comparator 172.

The comparator 172 compares the phase end-value from the selector 171 with the time parameter α from the time parameter generation circuit 941 to detect the current phase end-value. The comparator 172 supplies the detection signal to the OR gates 173 and 174.

Hence, the OR gate 173 receives the forced transition signal Wf from the interface circuit 8, i.e., a signal for requesting forced phase transition according to an instruction from the CPU 5, and the detection signal of the current phase end-value from the comparator 172, and the output from the OR gate 173 is supplied as the phase transition signal trn to the time parameter generation circuit 941 and the amplitude level reproduction circuit 942 shown in FIG. 12.

The AND gate 177 receives the forced transition signal Wf from the interface circuit 8 via the NOT gate 175, the clear signal Clf from the interface circuit 8 via the NOT gate 176, and the output from the OR gate 174, and the output from the AND gate 177 is supplied to the memory 178.

The memory 178 comprises, e.g., a RAM having the same number of words as the number of tone generation channels, and stores the outputs from the AND gate 177 in units of channels as parameter request signals RQf.

Note that the OR gate 174 receives the parameter request signal RQf stored in the memory 178, and the detection signal of the current phase end-value from the comparator 172, and its output is supplied to the AND gate 177, as described above.

Accordingly, the memory 178 stores the parameter request signal RQf of the next phase, which is supplied to the CPU 5 via the interface circuit 8 shown in FIG. 1.

As described above, the amplitude envelope signal Ec obtained by the amplitude envelope generation circuit 94 is supplied to the multiplier 93, which multiplies a tone signal FWD obtained by the digital filter circuit 92 by the amplitude envelope signal Ec.

The amplitude envelope signal Ec output from the amplitude envelope generation circuit 94 is controlled by the CPU 5, so that the electronic musical instrument 100 operates in response to the operation of the damper pedal 1.

The control processing of the amplitude envelope generation circuit 94 in the CPU 5 will be described in detail below.

Figure 19:
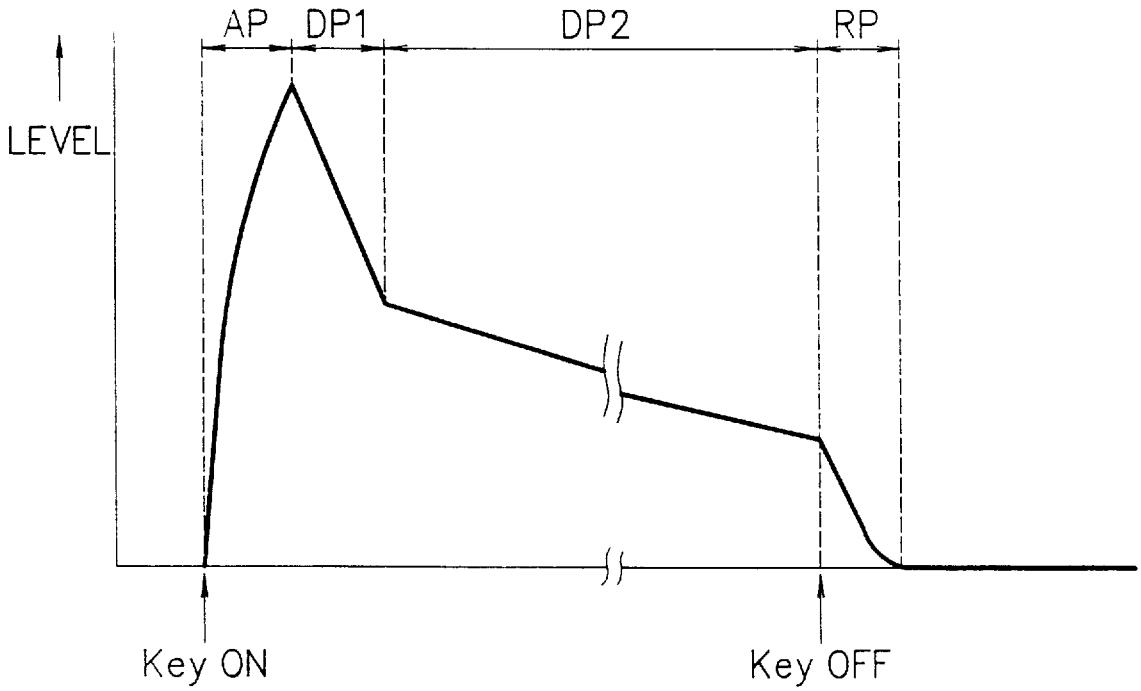
FIG. 19 is a graph for explaining the shape of the amplitude envelope.
Figure 20:
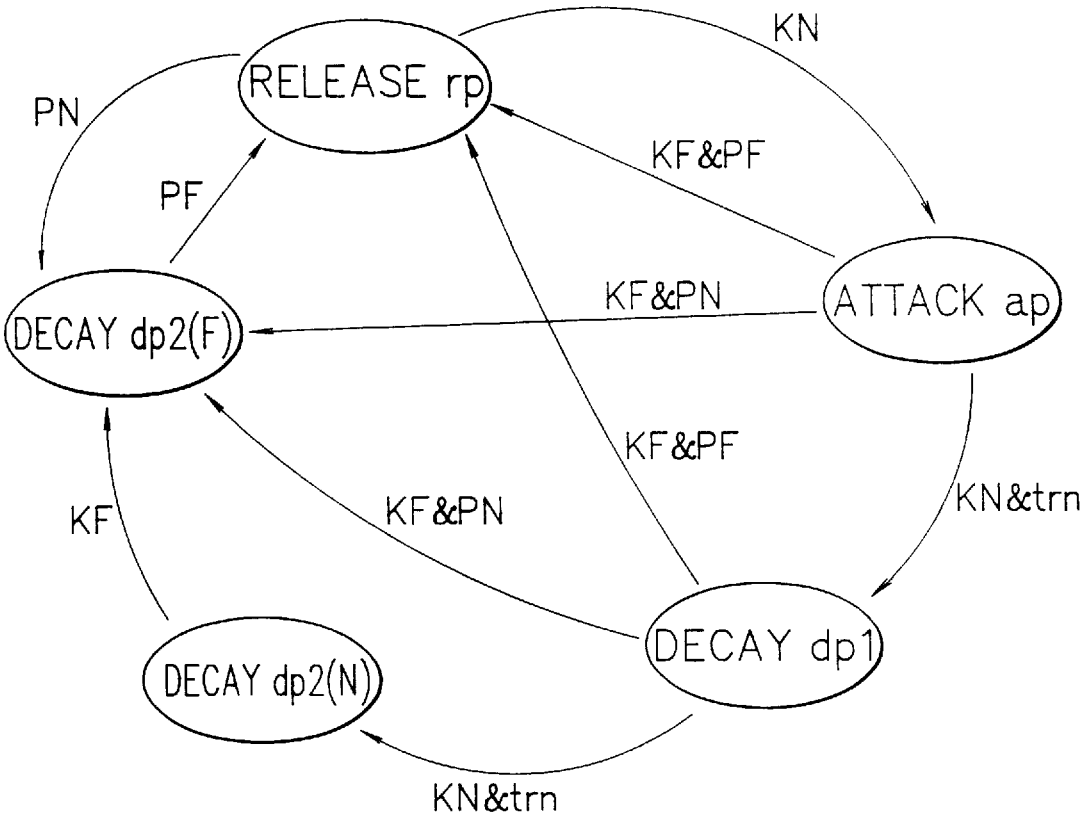
FIG. 20 PRIOR ART
FIG. 20 is a chart for explaining the conventional phase transition of the amplitude envelope.

In the electronic musical instrument 100, the amplitude envelope has a waveform, as shown in FIG. 19.

More specifically, a key ON phase consists of an attack phase AP, and decay phases DP1 and DP2, and a key OFF phase consists of a release phase RP.

In order to operate the electronic musical instrument 100 in response to the ON/OFF state of the damper pedal 1, the key OFF phase also consists of a plurality of phases to be described later. As the parameters for controlling the amplitude envelope, only parameters corresponding to four phases, i.e., the attack phase AP, decay phases DP1 and DP2, and release phase RP, are used.

In order to control the above-mentioned amplitude envelope, the CPU 5 supplies the parameters τ, L, and z of the attack phase AP to the amplitude envelope generation circuit 94 and sets the forced transition signal Wf of the interface circuit 8 at "true" level in the tone generation start processing.

At this time, the CPU 5 sets the parameter z of the attack phase AP at "false" level and sets the parameter L at a target level, i.e., attack level.

Subsequently, the CPU 5 supplies the parameters τ, L, and z of the decay phase DP1 to the amplitude envelope generation circuit 94.

At this time, the CPU 5 sets the parameter z of the decay phase DP1 at "true" level, and the parameter L at the phase end-value of the decay phase DP1. Also, the CPU 5 sets the forced transition signal Wf at "false" level.

When the CPU 5 recognizes that the parameter request RQf of the next phase from the amplitude envelope generation circuit 94 has become "true", it sets the clear signal C1f at "true" level to clear the parameter request signal RQf, and supplies the parameters τ, L, and z of the decay phase DP2 to the amplitude envelope generation circuit 94.

At this time, the CPU 5 sets the forced transition signal Wf at "false" level, and the parameter L of the decay phase DP2 at "0".

Note that the parameter z of the decay phase DP2 may be either "true" or "false" since the parameter L of the decay phase DP2 is set at "0".

When a tone generation stop instruction is issued in response to a key-OFF event, the CPU 5 supplies the parameters τ, L, and z of the release phase RP to the amplitude envelope generation circuit 94, and sets the forced transition signal Wf of the interface circuit 8 at"true" level.

At this time, the CPU 5 sets the parameter L of the release phase RP at "0".

Note that the parameter z of the release phase RP may be either "true" or "false" since the parameter L of the release phase RP is set at "0".

When the current phase is the release phase RP, if the damper pedal 1 is turned on, i.e., if a tone generation stop inhibition instruction is issued, the CPU 5 supplies the parameters τ, L, and z of the decay phase DP2 to the amplitude envelope generation circuit 94.

At this time, the CPU 5 sets the forced transition signal Wf at "true" level.

Figure 16:
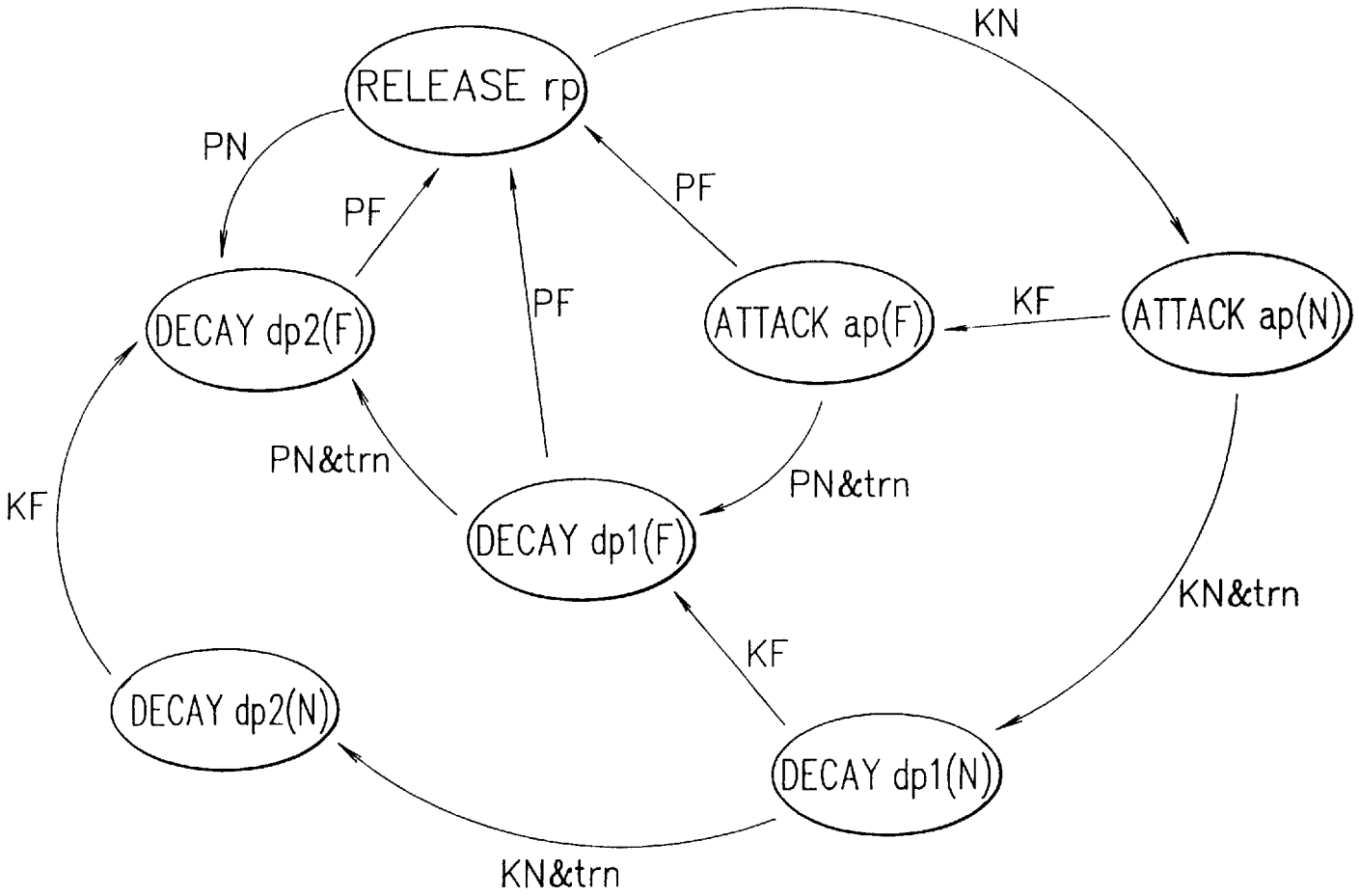
FIG. 16 is a chart for explaining the phase transition of the amplitude envelope in the electronic musical instrument.

FIG. 16 shows the phase transition according to the above-mentioned processing of the CPU 5.

As shown in FIG. 16, in this electronic musical instrument 100, in order to operate the electronic musical instrument 100 in response to the ON (N)/OFF (F) state of the damper pedal 1, seven phases, i.e., an attack phase ap(N), attack phase ap(F), decay phase dp1(N), decay phase dp1(F), decay phase dp2(N), decay phase dp2(F), and release phase rp are defined for the four phases, i.e., the attack phase AP, decay phases DP1 and DP2, and release phase RP shown in FIG. 19.

The three phases, i.e., the attack phase ap(F), decay phase dp1(F), and decay phase dp2(F) are those corresponding to the key OFF state and the ON state of the damper pedal 1.

As described above, the attack phases ap(N) and ap(F), decay phases dp1(N) and dp1(F), and decay phases dp2(N) and dp2(F) respectively use identical parameters.

As the key ON phases, the three phases, i.e., the attack phase ap(N), decay phase dp1(N), and decay phase dp2(N), and as the key OFF phases, the release phase rp, attack phase ap(F), decay phase dp1(F), and decay phase dp2(F) are used.

In FIG. 16, "KN" indicates the key ON event; "KF", the key OFF event; "PN", the damper pedal ON event; "PF", the damper pedal OFF event; "trn", the phase transition signal; and "&", the logical AND.

For example, if a certain key is turned on and the current phase is the attack phase ap(N), when the key is turned off, phase transition "attack phase ap(N)→attack phase ap(F)" is made.

In this case, since the attack phases ap(N) and ap(F) use identical parameters, a tone which is currently being produced is left unchanged.

At this time, if the damper pedal 1 is ON, the current phase stays in the attack phase ap(F).

On the other hand, if the damper pedal 1 is OFF, phase transition "attack phase ap(F)→release phase rp" is made.

On the other hand, when the current phase is the decay phase dp1(N) and a certain key is turned off, phase transition "decay phase dp1(N)→decay phase dp1(F)" is made.

In this case, since the decay phases dp1(N) and dp1(F) use identical parameters, a tone which is currently being produced is left unchanged.

At this time, if the damper pedal 1 is ON, the current phase stays in the decay phase dp1(F) until the request signal RQf from the amplitude envelope generation circuit 94 becomes "true".

On the other hand, if the damper pedal 1 is OFF, phase transition "decay phase dp1(F)→release phase rp" is made.

As described above, the electronic musical instrument 100 defines the attack phase AP as two attack phases ap(N) and ap(F), the decay phase DP1 as two decay phases dp1(N) and dp1(F), and the decay phase DP2 as two decay phases dp2(N) and dp2(F) in correspondence with the ON and OFF states of the damper pedal 1, and also defines the three phases, i.e., the attack phase ap(F), decay phase dp1(F), and decay phase dp2(F) as those corresponding to the key OFF state and the ON state of the damper pedal 1 so as to control the amplitude envelope. For this reason, even when a certain key is turned on and off within a short period of time, the attack rising can be prevented from being left half done, and the amplitude envelope can always be controlled in two decay stages.

Figure 17:
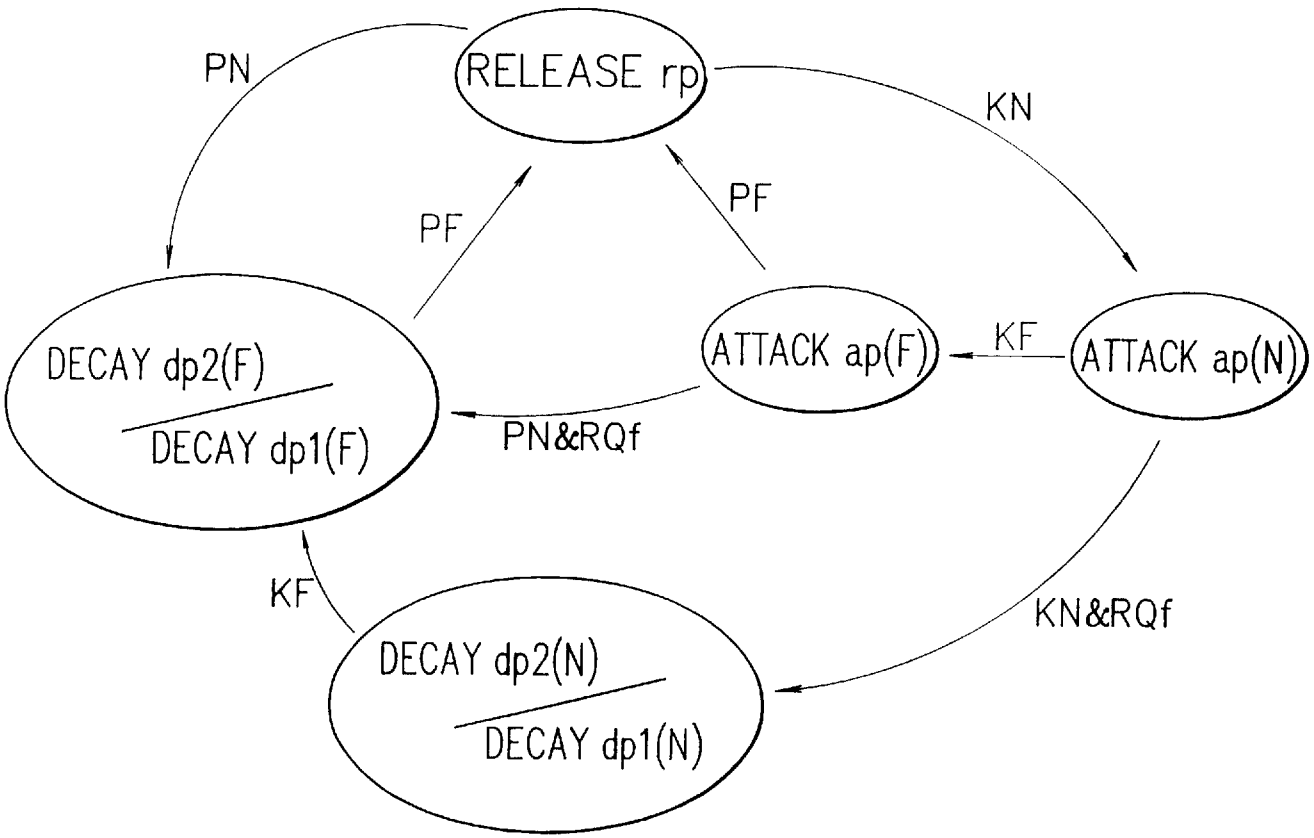
FIG. 17 is a chart for explaining the management of the phase transition by the CPU.

Since the amplitude envelope generation circuit 94 holds the parameters for two phases, the CPU 5 can easily manage the phase transition in accordance with the parameter request signal RQf from the amplitude envelope generation circuit 94 without specially distinguishing the decay phases dp1(N) and dp2(N), and the decay phases dp1(F) and dp2(F) from each other, as shown in FIG. 17.

Since the electronic musical instrument has the two tables, i.e., the TD-$\omega_0$ table Td and TD-Q table Te shown in FIG. 5, the resonant frequency $\omega_0$ and the Q factor for designating the filter characteristics of the digital filter circuit 92 can be arbitrarily changed in correspondence with key touch data, thus obtaining natural changes in tone characteristics corresponding to key touch data.

Figure 21:
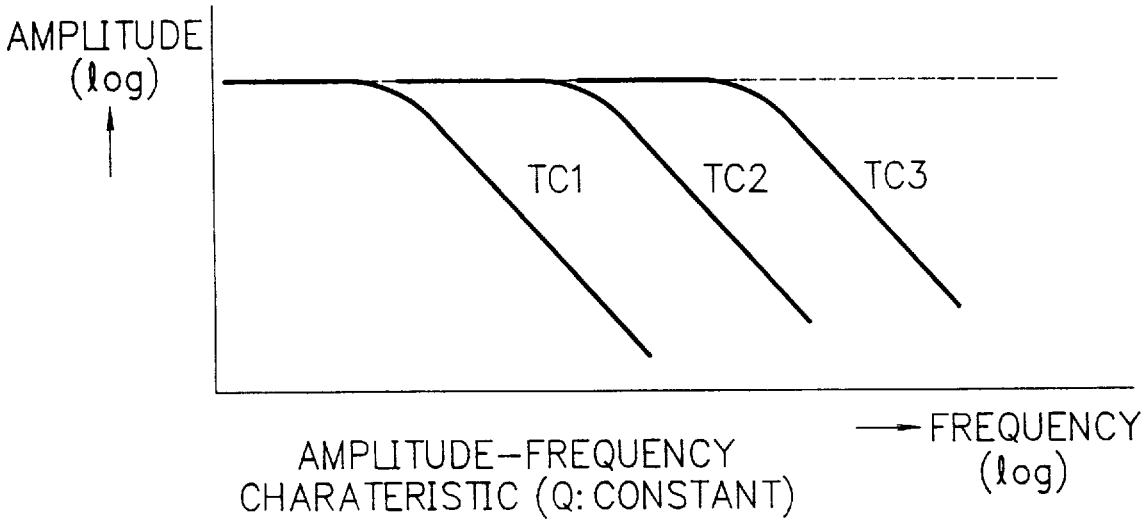
FIG. 21 PRIOR ART
FIG. 21 is a graph for explaining conventional filter characteristics.

Note that the above-mentioned electronic musical instrument 100 performs change control of the filter characteristics shown in FIG. 6. Alternatively, the filter characteristics may be changed using a constant Q factor, as shown in FIG. 21.

Also, each memory comprising the RAM having the same number of words as the number of tone generation channels used in the electronic musical instrument 100 may be replaced by a memory comprising a shift register having the same number of stages as the number of tone generation channels.

Figure 18:
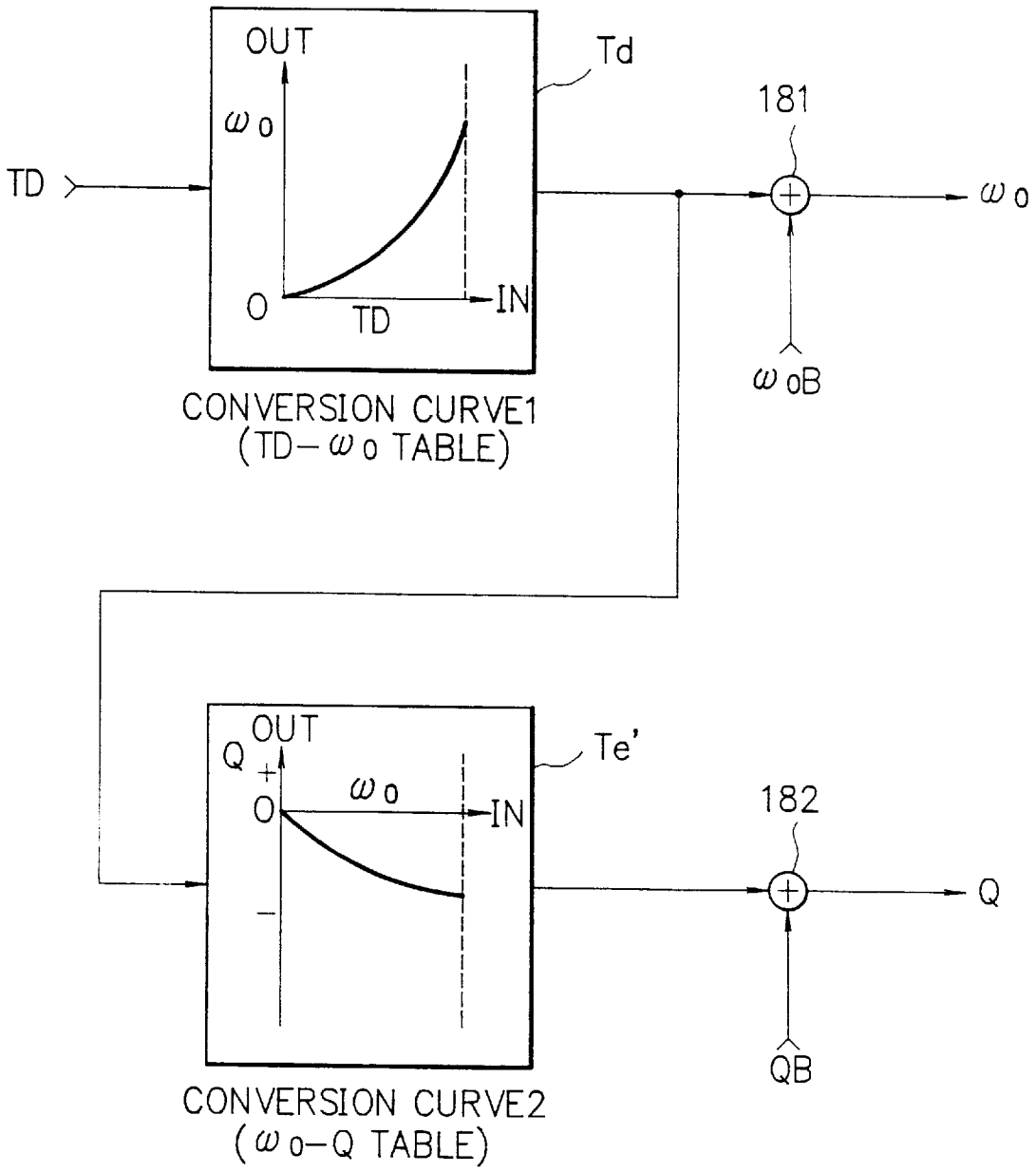
FIG. 18 is a flow graph for explaining the filter characteristic control processing of the CPU.

The CPU 5 arbitrarily changes the filter characteristics of the digital filter circuit 92 in correspondence with key touch data in accordance with the flow graph shown in FIG. 5. Alternatively, the CPU 5 may execute such change control in accordance with the flow graph shown in FIG. 18.

More specifically, in this case, touch data TD from the key scan/touch detection circuit 3 is converted using the TD-$\omega_0$ table Td, and the converted data is supplied to the adder 181. Also, the converted data is further converted using a $\omega_0$-Q table Te' arranged in place of the TD-Q table Te shown in FIG. 5, and the converted data is supplied to the adder 182.

Note that the $\omega_0$-Q table Te' is stored in the ROM 6.

As described above, according to the present invention, since the resonant frequency and the value indicating the resonance sharpness, which are used for controlling the filter characteristics of the tone generation means, can be arbitrarily changed in correspondence with the operation strength upon inputting a tone generation instruction at the tone generation instruction means, the characteristics of the tone to be generated can be naturally changed independently of its tone color. Accordingly, the tone can be naturally changed in correspondence with the operation strength.

According to the present invention, since the resonant frequency for controlling the filter characteristics of the tone generation means is arbitrarily changed in correspondence with the operation strength upon inputting a tone generation instruction at the tone generation instruction means, and the value indicating the resonance sharpness for controlling the filter characteristics of the tone generation means is arbitrarily changed in correspondence with the changed resonant frequency, the characteristics of the tone to be generated can be naturally changed independently of its tone color. Accordingly, the tone can be naturally changed in correspondence with the operation strength.

What is claimed is:

1. An electrical musical instrument comprising:

tone generation instruction means for inputting tone generation start and stop instructions of a tone;

detection means for detecting an operation strength upon inputting a tone generation instruction by said tone generation instruction means;

control means for controlling generation of a tone on the basis of the tone generation instruction input by said tone generation instruction means and the detection result of said detection means; and tone generation means for generating a tone controlled by said control means, comprising waveform generation means for generating a tone waveform responsive to instructions by said tone generation instruction means, said waveform generation means having a waveform memory which stores waveform data for generation of the tone waveform, wherein said tone generation means includes a digital filter for filtering the output waveform data from said waveform generation means, filter characteristics of said digital filter being controlled based on a resonant frequency and a resonance sharpness value by said control means, and generates a tone using the filter characteristics controlled by said control means, and said control means includes first table means which stores a plurality of resonant frequency data in correspondence with operation strengths, and second table means which stores a plurality of resonance sharpness value data in correspondence with operation strengths, the control means controls the filter characteristics using the resonant frequency data and the resonance sharpness value data selected from said first and second table means on the basis of the detection result of said detection means.

2. An electronic musical instrument according to claim 1, wherein said digital filter comprises a low-pass filter, and the resonant frequency determines a cutoff frequency of said low-pass filter.

3. An electronic musical instrument according to claim 1, wherein said control means for controlling the filter characteristics comprises:

storage means which stores base values of the resonant frequency data and base values of resonance sharpness value data in correspondence with a plurality of tone colors;

a first adder for adding the resonant frequency data read out from said first table means and the resonant frequency base value read out from said storage means; and a second adder for adding the resonance sharpness value data read out from said second table means and the base value of the resonant sharpness value data read out from said storage means.

4. An electronic musical instrument according to claim 1, wherein the resonance sharpness value is stored as a logarithmic value.

5. An electronic musical instrument according to claim 1, wherein said digital filter comprises:

a filter coefficient generation circuit for generating at least four filter coefficients (A, a, b, and f) on the basis of the resonant frequency data and the resonance sharpness value data; and multipliers for multiplying a tone signal by the filter coefficients A, a, b, and f.

6. An electronic musical instrument according to claim 5, wherein said filter coefficient generation circuit comprises:

a cosine function generator for generating a filter coefficient value A obtained by subtracting a cosine value of the resonant frequency data from 1;

a coefficient d-multiplier for forming a filter coefficient value a by multiplying the filter coefficient value A by a coefficient d;

a sine function generator for generating a sine value of the resonant frequency data; and a coefficient D-multiplier for forming a filter coefficient value b by multiplying the sine value by a coefficient D, the coefficient D being ½ reciprocal of resonance sharpness data Q, and the coefficient d being ½ reciprocal of the resonance sharpness data Q (when Q is not less than 1) or ½ a constant value (when Q is less than 1).

7. An electronic musical instrument according to claim 6, wherein said control means for controlling the filter characteristics comprises said second table means which stores the resonance sharpness value data as a logarithmic value, and said filter coefficient generation circuit comprises:

a complement circuit for calculating a complement of the logarithmic value;

a log-linear conversion circuit for converting the output from said complement circuit into a linear value;

division means for dividing the output from said log-linear conversion circuit by 2 to obtain the coefficient value D;

a comparator for comparing the coefficient value D and a constant value ½; and a selector for outputting the coefficient value D as a coefficient value d when the output from said comparator indicates $D \leqq ½$, and for outputting the constant value ½ as a coefficient value d when the output from said comparator indicates $D > ½$.

8. An electronic musical instrument according to claim 7, wherein said filter coefficient generation circuit comprises a function generator for receiving the filter coefficient b and outputting $f(b)=b/(1+b)$ as a filter coefficient f, and said function generator comprises a polygonal-line approximation circuit for generating the following values within corresponding ranges of the filter coefficient b ($0 \geqq b < 4$):

| | |
|---|---|
| $f(b) = b$ | $(0 \leqq b < 1/4)$ |
| $f(b) = b/2 + (2/16)$ | $(1/4 \leqq b < 1/2)$ |
| $f(b) = b/4 + (4/16)$ | $(1/2 \leqq b < 3/2)$ |
| $f(b) = b/8 + (7/16)$ | $(3/2 \leqq b < 2)$ |
| $f(b) = b/16 + (9/16)$ | $(2 \leqq b < 4)$ |

9. An electronic musical instrument according to claim 8, wherein said polygonal-line approximation circuit comprises:

a range discrimination circuit for discriminating the individual ranges of the filter coefficient b;

an offset generation circuit for generating an offset constant value on the basis of a range data output of said range discrimination circuit;

a divider for receiving the filter coefficient b and performing divisions by 2, 4, 8, and 16 in correspondence with the ranges; and an adder for adding the outputs from said offset generation circuit and said divider.

10. An electronic musical instrument according to claim 8, wherein said digital filter comprises:

a coefficient a-multiplier for multiplying an input tone signal by the filter coefficient a;

a coefficient b-multiplier for multiplying an output signal from said digital filter by the filter coefficient b;

a first adder for adding the output from said coefficient a-multiplier and the output from said coefficient b-multiplier;

a first delay circuit for delaying the output from said first adder by one sample time;

a first multiplier for multiplying the output from said coefficient a-multiplier by 2;

a coefficient A-multiplier for multiplying the output signal from said digital filter by the filter coefficient A;

a second multiplier for multiplying the output from said coefficient A-multiplier by 2;

a second adder for adding the outputs from said first and second multipliers;

a second delay circuit for delaying the output from said second adder by one sample time;

a third adder for adding the output from said coefficient a-multiplier and the output from said second delay circuit; and a coefficient f-multiplier for multiplying the output from said third adder by the filter coefficient f to obtain the output signal of said digital filter.

11. An electronic musical instrument according to claim 10, wherein said digital filter further comprises:

fourth, fifth, and sixth adders for respectively adding inputs and outputs of said coefficient b-multiplier, coefficient A-multiplier, and coefficient f-multiplier, and generating coefficient multiplied outputs.

12. An electronic musical instrument comprising:

tone generation instruction means for inputting tone generation start and stop instructions of a tone;

detection means for detecting an operation strength upon inputting a tone generation instruction by said tone generation instruction means;

control means for controlling generation of a tone on the basis of the tone generation instruction input by said tone generation instruction means and the detection result of said detection means; and tone generation means for generating a tone controlled by said control means, comprising waveform generation means for generating a tone waveform responsive to instructions by said tone generation instruction means, said waveform generation means having a waveform memory which stores waveform data for generation of the tone waveform, wherein said tone generation means includes a digital filter for filtering the output waveform data from said waveform generation means, filter characteristics of said digital filter being controlled based on a resonant frequency and a resonance sharpness value by said control means, and generates a tone using the filter characteristics controlled by said control means, and said control means includes first table means which stores a plurality of resonant frequency data in correspondence with operation strengths, and second table means which stores a plurality of resonance sharpness value data in correspondence with the resonant frequency data, the control means selects resonant frequency data from said first table means on the basis of the detection result of said detection mean, and selects a resonance sharpness value from said second table means on the basis of the selected resonant frequency data.

13. An electronic musical instrument according to claim 12, wherein said digital filter comprises a low-pass filter, and the resonant frequency determines a cutoff frequency of said low-pass filter.

14. An electronic musical instrument according to claim 12, wherein said control means for controlling the filter characteristics comprises:

storage means which stores base values of the resonant frequency data and base values of resonance sharpness value data in correspondence with a plurality of tone colors;

a first adder for adding the resonant frequency data read out from said first table means and the resonant frequency base value read out from said storage means; and a second adder for adding the resonance sharpness value data read out from said second table means and the base value of the resonant sharpness value data read out from said storage means.

15. An electronic musical instrument according to claim 12, wherein the resonance sharpness value is stored as a logarithmic value.

16. An electronic musical instrument according to claim 12, wherein said digital filter comprises a filter coefficient generation circuit for generating at least four filter coefficients (A, a, b, and f) on the basis of the resonant frequency data and the resonance sharpness value data, and multipliers for multiplying a tone signal by the filter coefficients A, a, b, and f.

17. An electronic musical instrument according to claim 16, wherein said filter coefficient generation circuit comprises:

a cosine function generator for generating a filter coefficient value A obtained by subtracting a cosine value of the resonant frequency data from 1;

a coefficient d-multiplier for forming a filter coefficient value a by multiplying the filter coefficient value A by a coefficient d;

a sine function generator for generating a sine value of the resonant frequency data; and a coefficient D-multiplier for forming a filter coefficient value b by multiplying the sine value by a coefficient D, the coefficient D being ½ reciprocal of resonance sharpness data Q, and the coefficient d being ½ reciprocal of the resonance sharpness data Q (when Q is not less than 1) or ½ a constant value (when Q is less than 1).

18. An electronic musical instrument according to claim 17, wherein said control means for controlling the filter characteristics comprises said second table means which stores the resonance sharpness value data as a logarithmic value, and said filter coefficient generation circuit comprises:

a complement circuit for calculating a complement of the logarithmic value;

a log-linear conversion circuit for converting the output from said complement circuit into a linear value;

division means for dividing the output from said log-linear conversion circuit by 2 to obtain the coefficient value D;

a comparator for comparing the coefficient value D and a constant value ½; and a selector for outputting the coefficient value D as a coefficient value d when the output from said comparator indicates D≦½, and for outputting the constant value ½ as a coefficient value d when the output from said comparator indicates D>½.

19. An electronic musical instrument according to claim 18, wherein said filter coefficient generation circuit comprises a function generator for receiving the filter coefficient b and outputting f(b)=b/(1+b) as a filter coefficient f, and said function generator comprises a polygonal-line approximation circuit for generating the following values within corresponding ranges of the filter coefficient b (0≦b<4):

| | |
|---|---|
| f(b) = b | (0 ≦ b < 1/4) |
| f(b) = b/2 + (2/16) | (1/4 ≦ b < 1/2) |
| f(b) = b/4 + (4/16) | (1/2 ≦ b < 3/2) |
| f(b) = b/8 + (7/16) | (3/2 ≦ b < 2) |
| f(b) = b/16 + (9/16) | (2 ≦ b < 4) |

20. An electronic musical instrument according to claim 19, wherein said polygonal-line approximation circuit comprises:

a range discrimination circuit for discriminating the individual ranges of the filter coefficient b;

an offset generation circuit for generating an offset constant value on the basis of a range data output of said range discrimination circuit;

a divider for receiving the filter coefficient b and performing divisions by 2, 4, 8, and 16 in correspondence with the ranges; and an adder for adding the outputs from said offset generation circuit and said divider.

21. An electronic musical instrument according to claim 19, wherein said digital filter comprises:

a coefficient a-multiplier for multiplying an input tone signal by the filter coefficient a;

a coefficient b-multiplier for multiplying an output signal from said digital filter by the filter coefficient b;

a first adder for adding the output from said coefficient a-multiplier and the output from said coefficient b-multiplier;

a first delay circuit for delaying the output from said first adder by one sample time;

a first multiplier for multiplying the output from said coefficient a-multiplier by 2;

a coefficient A-multiplier for multiplying the output signal from said digital filter by the filter coefficient A;

a second multiplier for multiplying the output from said coefficient A-multiplier by 2;

a second adder for adding the outputs from said first and second multipliers;

a second delay circuit for delaying the output from said second adder by one sample time;

a third adder for adding the output from said coefficient a-multiplier and the output from said second delay circuit; and a coefficient f-multiplier for multiplying the output from said third adder by the filter coefficient f to obtain the output single of said digital filter.

22. An electronic musical instrument according to claim 21, wherein said digital filter further comprises:

fourth, fifth, and sixth adders for respectively adding inputs and outputs of said coefficient b-multiplier, coefficient A-multiplier, and coefficient f-multiplier and generating coefficient multiplied outputs.

* * * * *